US010156094B2

(12) United States Patent
Lin

(10) Patent No.: US 10,156,094 B2
(45) Date of Patent: Dec. 18, 2018

(54) ROLL-UP SHADE HAVING ADJUSTABLE CLIPS FOR HEIGHT ADJUSTMENT

(71) Applicant: Whole Space Industries LTD, Taipei (TW)

(72) Inventor: Tzu-Yen Lin, Taipei (TW)

(73) Assignee: Whole Space Industries LTD, Taipei (TW)

( * ) Notice: Subject to any disclaimer, the term of this patent is extended or adjusted under 35 U.S.C. 154(b) by 59 days.

(21) Appl. No.: 15/403,390

(22) Filed: Jan. 11, 2017

(65) Prior Publication Data

US 2017/0218701 A1 Aug. 3, 2017

Related U.S. Application Data

(60) Provisional application No. 62/340,031, filed on May 23, 2016, provisional application No. 62/319,858, filed on Apr. 8, 2016, provisional application No. 62/289,569, filed on Feb. 1, 2016.

(51) Int. Cl.

| | |
|---|---|
| ***E06B 9/66*** | (2006.01) |
| ***E06B 9/78*** | (2006.01) |
| ***E06B 9/264*** | (2006.01) |
| ***E06B 9/42*** | (2006.01) |
| ***E06B 9/60*** | (2006.01) |
| ***E06B 9/382*** | (2006.01) |
| ***E06B 9/80*** | (2006.01) |

(52) U.S. Cl.

CPC ..... *E06B 9/78* (2013.01); *E06B 9/264* (2013.01); *E06B 9/382* (2013.01); *E06B 9/42* (2013.01); *E06B 9/60* (2013.01); *E06B 9/66* (2013.01); *E06B 9/80* (2013.01); *E06B 2009/425* (2013.01); *E06B 2009/804* (2013.01)

(58) Field of Classification Search

CPC ... E06B 9/78; E06B 9/382; E06B 9/42; E06B 9/66; E06B 9/80; E06B 2009/425; E06B 2009/804; E06B 9/40

USPC ..... 160/242–243, 246

See application file for complete search history.

(56) References Cited

U.S. PATENT DOCUMENTS

| | | | | |
|---|---|---|---|---|
| D102,326 S | | 4/1870 | Shirts | |
| 201,710 A | * | 3/1878 | Shaw | E06B 9/42 160/245 |
| 530,079 A | * | 12/1894 | Bergstresser et al. | A47H 23/04 160/29 |

(Continued)

*Primary Examiner* — Katherine W Mitchell
*Assistant Examiner* — Jeremy C Ramsey
(74) *Attorney, Agent, or Firm* — Buchanan Ingersoll & Rooney PC

(57) ABSTRACT

A window covering can be configured as roll-up shade. The window covering can have a plurality of clips that are configured to be moveable from a first position in which the clips engage window covering material and a second position at which the clips do not engage the window covering material. When the clips are in the second position, the window covering material is manually adjustable from between a fully extended position to a retracted position. When the window covering material is moved to a retracted position, the lower portion of the window covering material may be rolled up upon height adjustment to form a roll of the window covering material. After the adjustment of the window covering material, the clips can be moved to their first position to engage the unrolled material to maintain a position of the rolled up material.

18 Claims, 19 Drawing Sheets

(56) References Cited

U.S. PATENT DOCUMENTS

| | | | | |
|---|---|---|---|---|
| 1,042,805 | A | 10/1912 | Lovell | |
| 1,053,658 | A | 2/1913 | Sinclair | |
| 2,116,237 | A * | 5/1938 | Ehlers | E06B 9/58 160/244 |
| 5,913,564 | A | 6/1999 | Stewart et al. | |
| 5,966,854 | A * | 10/1999 | Walsh | G09F 11/29 160/243 |
| 6,834,701 | B2 | 12/2004 | Colson et al. | |
| 6,860,312 | B2 | 3/2005 | Judkins | |
| 7,086,446 | B2 | 8/2006 | Kollman et al. | |
| 8,186,412 | B2 * | 5/2012 | Lin | E06B 9/262 160/108 |
| 9,896,883 | B1 * | 2/2018 | Cheng | E06B 9/50 |
| 2004/0060670 | A1 * | 4/2004 | Judkins | E06B 9/28 160/243 |
| 2005/0257902 | A1 * | 11/2005 | Pernicano | E04H 15/32 160/243 |
| 2009/0308545 | A1 * | 12/2009 | An | E06B 9/42 160/313 |
| 2013/0269885 | A1 | 10/2013 | Cavarec et al. | |
| 2017/0218702 | A1 * | 8/2017 | Lin | E06B 9/382 |

* cited by examiner

ROLL-UP SHADE HAVING ADJUSTABLE CLIPS FOR HEIGHT ADJUSTMENT

CROSS-REFERENCE TO RELATED APPLICATIONS

This application claims priority to U.S. Provisional Patent Application No. 62/289,569, filed on Feb. 1, 2016, U.S. Provisional Patent Application No. 62/319,858, filed on Apr. 8, 2016, and U.S. Provisional Patent Application No. 62/340,031, filed on May 23, 2016. The entirety of U.S. Provisional Patent Application No. 62/289,569 is incorporated herein by reference. The entirety of U.S. Provisional Patent Application No. 62/319,858 is incorporated herein by reference. The entirety of U.S. Provisional Patent Application No. 62/340,031 is incorporated herein by reference.

FILED OF THE INVENTION

The present invention relates to window coverings such as roll-up shades.

BACKGROUND OF THE INVENTION

Examples of roll-up shades can be appreciated from U.S. Pat. Nos. 6,860,312 and 7,086,446. Roll-up shades often include a panel of window covering material attached at its top edge to a headrail. Two or more looped lift cords extend from the headrail down a front face of the panel of window covering material, around the bottom edge of the panel and up an opposite rear face of the panel of window covering material into the headrail. The lift cords may then pass through a cord lock in the headrail or wind around a cord collector within the headrail that is coupled to a spring motor, electric motor, or a loop cord drive. Movement of the lift cords into the headrail can cause the panel of window covering material to roll-up as the window covering material is raised and movement of the lift cords out of the headrail can cause the window covering material to unroll as it is lowered. The looped lift cords are spaced apart from one another. The number of looped lift cords can typically depend upon the width of the window covering material but most, if not all, conventional roll-up shades have at least two looped lift cords.

In recent years there has been an increased concern in the window covering industry about child safety as it relates to exposed cords. For instance, there have been instances involving some types of blinds in which a child's head and neck have become entangled in a cord loop that is used to raise and lower the blind. Roll-up shades often have looped lift cords in which the panel of window covering material is captured. Some have observed that the exposed looped lift cords in a conventional roll-up shade could pose the same danger as lift cord loops that are can be formed in connection with other types of blinds such as a venetian blind.

SUMMARY OF THE INVENTION

I have determined that a new mechanism is needed to provide a means by which window covering material can be rolled up for raising of a window covering and unrolled for lowering of a window covering. A new window covering is provided and a new method of adjusting a position of window covering material of a window covering is also provided. Some embodiments of the window covering can be configured as a cordless roll-up shade. Embodiments of the window covering can be configured so that the unrolling, or lowering, of the window covering material as well as the rolling up, or raising, of the window covering material can occur without the use of any exposed lift cords so that lift cord entanglements can be avoided. In some embodiments, the window covering can be configured so that the window covering can be made for a relatively low cost by not including any lift cords and not including a spring motor, electric motor, loop cord drive, or other type of lift cord control mechanism coupled to such lift cords for controlling the positioning of window covering material.

In some embodiments, a window covering can include a first rail and window covering material that is connected to the first rail such that the window covering material is moveable between a first position (e.g. a fully extended position or a substantially extended position) and a second position (e.g. a retracted position or a substantially retracted position). A first lower portion of the window covering material and a second portion of the window covering material can be rolled up when the window covering material is in the second position (e.g. a fully retracted position or a partially retracted position). A third portion of the window covering material may be located above the first and second portions of the window covering material when the window covering material is in the second position. A first clip can be attachable to the window covering material to extend between the third portion of the window covering material and one of the first portion of the window covering material and the second portion of the window covering material when the window covering material is in the second position to maintain the window covering material in the second position. The first clip can be removable from at least the third portion of the window covering material to facilitate adjustment of the window covering material from the second position to a third position that is located between the first and second positions. The first portion of the window covering material can be rolled up when the window covering material is in the third position (e.g. a position between the first and second positions). The first clip can be reattachable to the window covering material such that the first clip extends between the first portion of the window covering material and an unrolled portion of the window covering material that is above the first portion to engage the window covering material to maintain the window covering material in the third position.

In some embodiments, the unrolled portion of the window covering material that is above the first portion when the window covering material is in the third position can be the second portion of the window covering material. In other embodiments, that unrolled portion could be some other segment of the formerly rolled up window covering material that was unrolled upon lowering of the window covering material.

The rolled up portion of the window covering material may be a portion of the window covering material that is rolled about a bottom rail connected to the bottom of the window covering material or that is rolled about a bottom side of the window covering material. The rolling up of the window covering material may result in the window covering material rolling up into a roll having a diameter or width that increases as the window covering material is raised to a fully retracted position as window covering material is rolled about itself upon multiple revolutions to form the bottom rolled up portion as the window covering material is retracted, or raised. The fully retracted position could also be considered a fully raised position or a fully open position.

In some embodiments, when the window covering material is in a fully extended position, there may not be any portion of the window covering material rolled up. In other embodiments, the window covering can be configured so that when the window covering is fully extended a bottom portion of the window covering material is still rolled up. The fully extended position could also be considered a closed position or a fully lowered position. It should be appreciated that the window covering material of the bottom rolled up portion that is formed when the window covering material is moved to the fully retracted position can be unrolled to form a segment of the unrolled portion of the window covering material that is located above the rolled up portion as the window covering material is lowered, or extended, from its fully retracted position. The unrolling of the material can result in the rolled-up portion having a decreasing width, or diameter, as the window covering material is unrolled during lowering, or extension, of the window covering material.

The window covering can include multiple clips. For instance, embodiments could include a second clip attachable to the window covering material to extend between the third portion of the window covering material and one of the first portion of the window covering material and the second portion of the window covering material when the window covering material is in the second position. The second clip can be removable from at least the third portion of the window covering material to facilitate adjustment of the window covering material from the second position to the third position. The second clip can be reattachable to the window covering material such that the first clip extends between the first portion of the window covering material and an unrolled portion of the window covering material that is above the first portion to engage the window covering material to maintain a location of the first position of the window covering material. In yet other embodiments, the window covering can include multiple other clips having a construction that is the same as the first clip or is similar to the first clip.

In some embodiments, the window covering material can have a first side and a second side that is opposite the first side. These sides may be left and right sides that extend from the bottom of the window covering material to the top of the window covering material. A front face of the window covering material may be defined by the top, bottom, first and second sides of the window covering material and a rear face of the window covering material may be opposite this front face and similarly defined by the top, bottom, first and second sides of the window covering material. The first clip can be attached to the window covering material adjacent the first side and a second clip can attached to the window covering material adjacent the second side. The clips may include one or more profiles, features, or mechanism that are configured to engage the front and/or rear faces of the window covering material.

The bottom rail can be attached to a bottom portion of the window covering material. The first clip can be attached adjacent to the first side of the window covering material via attachment to the bottom rail and the second clip can be attached adjacent to the second side of the window covering material via attachment to the bottom rail.

In some embodiments, the first clip can be configured to be removable from the third portion by motion of the first clip from an engaged position to a disengaged position. The first clip can have prongs contacting the third portion when the first clip is in the engaged position and the prongs of the first clip may not contact the third portion when the first clip is in the disengaged position. The second clip can also be configured to be removable from the third portion by motion of the second clip from an engaged position to a disengaged position. The second clip can have prongs contacting the third portion when the second clip is in the engaged position and the prongs of the second clip may not contact the third portion when the first clip is in the disengaged position.

In other embodiments, the first clip can have a first hook end and a second hook end. The first hook end of the first clip can be releaseably attachable to the third portion of the window covering material and the second hook end of the first clip can be releaseably attachable to one of the first portion and the second portion of the window covering material when the window covering material is in the second position. Embodiments that utilize at least one other clip, such as a second clip, can be structured so that the second clip has the same structure as the first clip. For instance, the second clip can have a first hook end and a second hook end. The first hook end of the second clip can be releaseably attachable to the third portion of the window covering material and the second hook end of the second clip can be releaseably attachable to one of the first portion and the second portion of the window covering material when the window covering material is in the second position. The first and second hook ends of the clips can be moved to engaged positions by hooking those ends to window covering material or a profile or connector of a bottom rail or first rail. The first and second hook ends of the clips can be moved to disengaged positions by removing the hook ends from the window covering material, first rail, or bottom rail to which they may be attached.

The window covering material can be comprised of any of a number of suitable materials to function as a window covering material and provide a pre-selected aesthetic effect and/or insulative effect. For instance, the window covering material can be comprised of woven wood, a sheet of material, a sheet of fabric material, woven bamboo, a sheet of rollable material comprised of a plurality of polymeric slats being connected together, or a sheet of non-woven fabric material. The window covering material can be moveable via manual motion of the window covering material without use of any lift cords. The rolling up and unrolling of the window covering material can be facilitated by such manual motion. The manual motion of the window covering material can be performed without use of an electric motor and without use of a spring motor, without use of a loop cord drive, and without use of one or more lift cords.

In other contemplated embodiments, a window covering material control mechanism can be coupled to the window covering material to help facilitate motion of the window covering material. Such a mechanism may include a spring motor or other type of drive coupled to a rotatable shaft that may be driven to drive motion of the window covering material.

A method of adjusting a position of window covering material of a window covering from a first position to a second position is also provided. Embodiments of this method can include the steps of moving the window covering material to a first position, positioning clips on the window covering material after the window covering material is moved to the first position so that the clips extend from a rolled up portion of the window covering material to an unrolled up portion of the window covering material located above the rolled up portion of the window covering material so that the clips engage the unrolled portion to maintain a position of the rolled up portion of the window covering material and keep the window covering material in the first position, adjusting positions of the clips so that the clips do not engage the unrolled portion of the window covering material after the window covering material is moved to the first position and after the clips were positioned on the window covering material, and moving the window covering material to a second position after adjusting the positions of the clips so that the clips do not engage the unrolled up portion of the window covering material. The clips can then be positioned on the window covering material after the window covering material is moved to the second position so that the clips extend from a rolled up portion of the window covering material to an unrolled up portion of the window covering material located above the rolled up portion of the window covering material so that the clips engage the unrolled portion to maintain a position of the rolled up portion of the window covering material to keep the window covering material in the second position.

In some embodiments, the method may be performed so that no lift cords and no motor is utilized to maintain the position of the rolled up portion of the window covering material and/or move the window covering material. A loop cord drive may also not be utilized to maintain the position of the rolled up portion of the window covering material and/or move the window covering material.

In some embodiments of the method, the moving of the window covering material to the second position can include at least partially unrolling the rolled up portion of the window covering or rolling up a portion of the unrolled portion of the window covering material.

The method can also include the step of adjusting of the positions of the clips after the window covering material is placed into the second position so that the clips extend from adjacent a rolled up portion of the window covering material to an unrolled up portion of the window covering material located above the rolled up portion of the window covering material so that the clips engage the unrolled portion to maintain the window covering material in the second position. The positioning of such clips can occur so that the use of lift cords is not needed or used for the maintaining of the position of the window covering material and/or the adjustment of the positioning of the window covering material.

In some embodiments of the method, each of the clips can be configured to have a body having a first hook end and a second hook end opposite the first hook end. The first hook end can be configured to be releaseably attachable to the window covering material and the second hook end can be configured to be releaseably attachable to the window covering material. In other embodiments, each of the clips can be configured to have a body having a first end configured to be attached to a bottom rail positioned adjacent to a bottom of the window covering material and a second end opposite the first end. The second end can have prongs that are spaced apart to receive and engage the window covering material. The prongs can be moveable between an engaged position and a disengaged position. The prongs can be positioned to receive the window covering material and contact the window covering material when in the engaged position. The prongs can be spaced apart from the window covering material so the prongs do not contact the window covering material when in the disengaged position.

In some embodiments, a window covering can include a first rail (e.g. a middle rail of a top down bottom up shade or a headrail) and window covering material connected to the first rail such that the window covering material is moveable between a first position and a second position. A first lower portion of the window covering material and a second portion of the window covering material can be rolled up when the window covering material is in the second position. A third portion of the window covering material can be located above the first and second portions of the window covering material when the window covering material is in the second position. A first clip assembly can have a first body attached to one of a first end of a bottom rail and the first lower portion of the window covering material. The first clip assembly can also have a first hook member that is moveably connected to the first body such that the first hook member is moveable from a retracted position to an extended position. The first hook member can be extended away from the first body and engageable with at least one of the third portion of the window covering material and a first connector attached to the third portion of the window covering material when in the engaged position of the first hook member. The first hook member can be positioned adjacent to the first body and disengaged from the at least one of the window covering material and the first connector when in the retracted position of the first hook member. The first hook member can be moveable to the engaged position of the first hook member to engage at least one of the third portion of the window covering material and the first connector to maintain the window covering material in the second position and the first hook member can be moveable to the retracted position so that the window covering material is moveable to the first position. The second portion of the window covering material can be unrolled when the window covering material is in the first position. In some embodiments, the first lower portion of the window covering material can also be unrolled when the window covering material is the first position. In other embodiments, the first lower portion may still be rolled up when the window covering material is in the first position and the second portion of the window covering material is unrolled and located above the rolled up first lower portion.

A second clip assembly can be included in embodiments of the window covering. The second clip assembly can include a second body attached to one of a second end of the bottom rail and the first lower portion of the window covering material. The second clip assembly can also have a second hook member that is moveably connected to the second body such that the second hook member is moveable from a retracted position to an extended position. The second hook member can extended away from the second body and engageable with at least one of the third portion of the window covering material and a second connector attached to the third portion of the window covering material when in the engaged position of the second hook member. The second hook member can be positioned adjacent the second body and disengaged from the at least one of the window covering material and the second connector when in the retracted position of the second hook member. The second hook member can be moveable to the engaged position of the second hook member to engage at least one of the third portion of the window covering material and the second connector to maintain the window covering material in the second position and the second hook member can be moveable to the retracted position so that the window covering material is moveable to the first position of the window covering material.

The window covering material can have a first side and a second side that is opposite the first side, the first clip assembly being attached adjacent to the first side and the second clip assembly being attached adjacent the second side. The window covering material may also have a top connected to the first rail and a bottom connected to the bottom rail. In some contemplated embodiments, there may not be a bottom rail. In embodiments in which there is a bottom rail, the first body can be attached to the first end of the bottom rail and the second body can be attached to the second end of the bottom rail that is opposite the first end of the bottom rail.

In some embodiments, the first hook member can be pivotally attached to the first body and be pivotally moveable between the extended position of the first hook member and the retracted position of the first hook member. The second hook member can be pivotally attached to the second body and be pivotally moveable between the extended position of the second hook member and the retracted position of the second hook member.

In some embodiments, the first hook member can be attached to the first body via one of a first elongated member and a first cord and the second hook member can be attached to the second body via one of a second elongated member and a second cord. The first elongated member or the first cord can be releaseably attached to the first body and the second elongated member or the second cord can releaseably attached to the second body. For instance, the first and second bodies may have openings sized to releaseably retain a mateable body attached to a distal end of the cord or elongated member to which it is releaseably attached. Alternatively, the first and second bodies may have a nose or other structure that is releasable insertable into openings of members attached to the distal ends of the elongated members or cords for the releasable attachment of the cords or elongated members to those bodies.

In some embodiments, the first connector can be a loop or ring and the second connector can be a loop or ring. The first connector may be one connector of a set of first connectors that are aligned adjacent a first side of the window covering material and vertically spaced apart from each other along a length of the window covering material. The second connector may be one connector of a set of second connectors that are aligned adjacent a second side of the window covering material and vertically spaced apart from each other along a length of the window covering material.

In some embodiments, the first body can be a rotatable pulley positioned inside the bottom rail and the second body is a rotatable body positioned inside the bottom rail. The rotatable first and second bodies may be located adjacent respective ends of the bottom rail or may be located further within the bottom rail. For such embodiments, the first clip assembly can also comprise at least one spring connected to the first body and the second clip assembly can also comprises at least one spring connected to the second body. For instance, the first clip assembly can also comprise at least one spring motor connected to the first body and the second clip assembly can also comprise at least one spring motor connected to the second body. As another example, the at least one spring connected to the first rotatable body may be a spring within that rotatable body that biases the body to rotate to wind up a first cord or first elongated member. The at least one spring connected to the second rotatable body may be second spring connected to the second rotatable body to bias the second rotatable body to wind up the second cord or second elongated member. A first cord or a first line can extend from the first body to the first hook member to connect the first hook member to the first body and a second cord or second line can extend from the second body to the second hook member to connect the second hook member to the second body. In some embodiments, the first body can be rotatable in a first direction when the first hook member is moved to the extended position of the first hook member and is rotatable in a second direction that is opposite the first direction when the first hook member is moved to the retracted position. The first cord or the first line can be windable on the first body when the first body rotates in the second direction and the first cord or the first line can be unwindble from the first body when the first body rotates in the first direction. The second body can also be rotatable in a first direction when the second hook member is moved to the extended position of the second hook member and is rotatable in a second direction that is opposite the first direction when the second hook member is moved to the retracted position, the second cord or the second line being windable on the second body when the second body rotates in the second direction and the second cord or the second line being unwindble from the second body when the second body rotates in the first direction. The first direction at which the second rotatable body rotates may be a direction that is opposite the first direction that the first rotatable body rotates and the second direction at which the second rotatable body rotates may be a direction that is opposite the second direction at which the first rotatable body rotates.

In some embodiments of a method of adjusting a position of window covering material of a window covering from a first position to a second position, the method can include the steps of positioning clip assemblies so that hook members of the clip assemblies engage at least one of the window covering material and connectors attached to the window covering material after the window covering material is moved to the second position so that the hook members engage at least one of an unrolled up portion of the window covering material and the connectors to maintain a position of a rolled up portion of the window covering material located below the rolled up portion of the window covering material, adjusting positions of the clip assemblies so that the hook members do not engage the unrolled portion of the window covering material and do not engage the connectors, and moving the window covering material from the second position to the first position after adjusting the positions of the clip assemblies. At least a portion of the rolled up portion of the window covering can be unrolled when the window covering material is moved to the first position. In some embodiments, the entirety of the window covering material can be unrolled when the window covering material is in the first position. In other embodiments, at least a lower portion of the window covering material may still be rolled up when the window covering material is in the first position.

In some embodiments, the adjusting of the positions of the clip assemblies can comprise moving the hook members from engaged positions of the hook members to disengaged positions of the hook members. Each of the clip assemblies can be comprised of a body attached to at least one of a bottom rail attached to a lower portion of the window covering material and the lower portion of the window covering material. The hook member of the clip assembly can be moveably attached to the body of the clip assembly.

Other details, objects, and advantages of the window covering and method will become apparent as the following description of certain exemplary embodiments thereof proceeds.

BRIEF DESCRIPTION OF THE DRAWINGS

Exemplary embodiments of the window covering and methods of making the same are shown in the accompanying drawings. It should be understood that like reference numbers used in the drawings may identify like components.

DETAILED DESCRIPTION OF EXEMPLARY EMBODIMENTS

Figure 1:
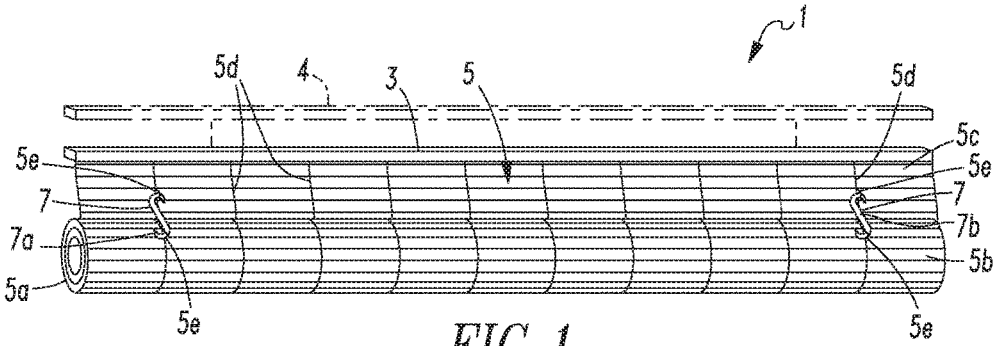
FIG. 1 is a perspective view of a first exemplary embodiment of the window covering with the window covering material in a first position.

As can be appreciated from FIGS. 1-23, embodiments of the window covering 1 can include a first rail 3. The first rail 3 may be a headrail. In other embodiments, it is contemplated that the first rail 3 can be the intermediate rail of a top down bottom up shade design in which the intermediate first rail is moveably coupled to an upper rail 4 (shown in broken line in FIG. 1) so that the first rail 3 would be moveable relative to that upper rail 4.

Window covering material 5 can have a top end connected to the first rail 3 and may have a bottom end connected to a bottom rail 13. It is contemplated that some embodiments may not include a bottom rail 13. For such embodiments, the bottom end of the window covering material 5 may be the bottommost element of the window covering. The window covering material 5 can be composed of a sheet of woven wood, a sheet of material, a sheet of fabric material, a sheet of woven bamboo, a sheet of rollable material comprised of a plurality of polymeric slats being connected together, or a sheet of non-woven fabric material. In other embodiments, the window covering material 5 could be another type of material that has a lower portion that is rollable upon raising of the window covering material so that the material can form a rolled-up portion as the window covering material is raised. The width, or diameter, of the rolled-up portion may increase as the window covering material is rolled up upon raising of the window covering material 5. Upon lowering of the window covering material, or extension of the window covering material, the rolled-up portion may be unrolled so that the rolled up portion's width, or diameter, decreases as the window covering material 5 is lowered, or extended.

Figure 2:
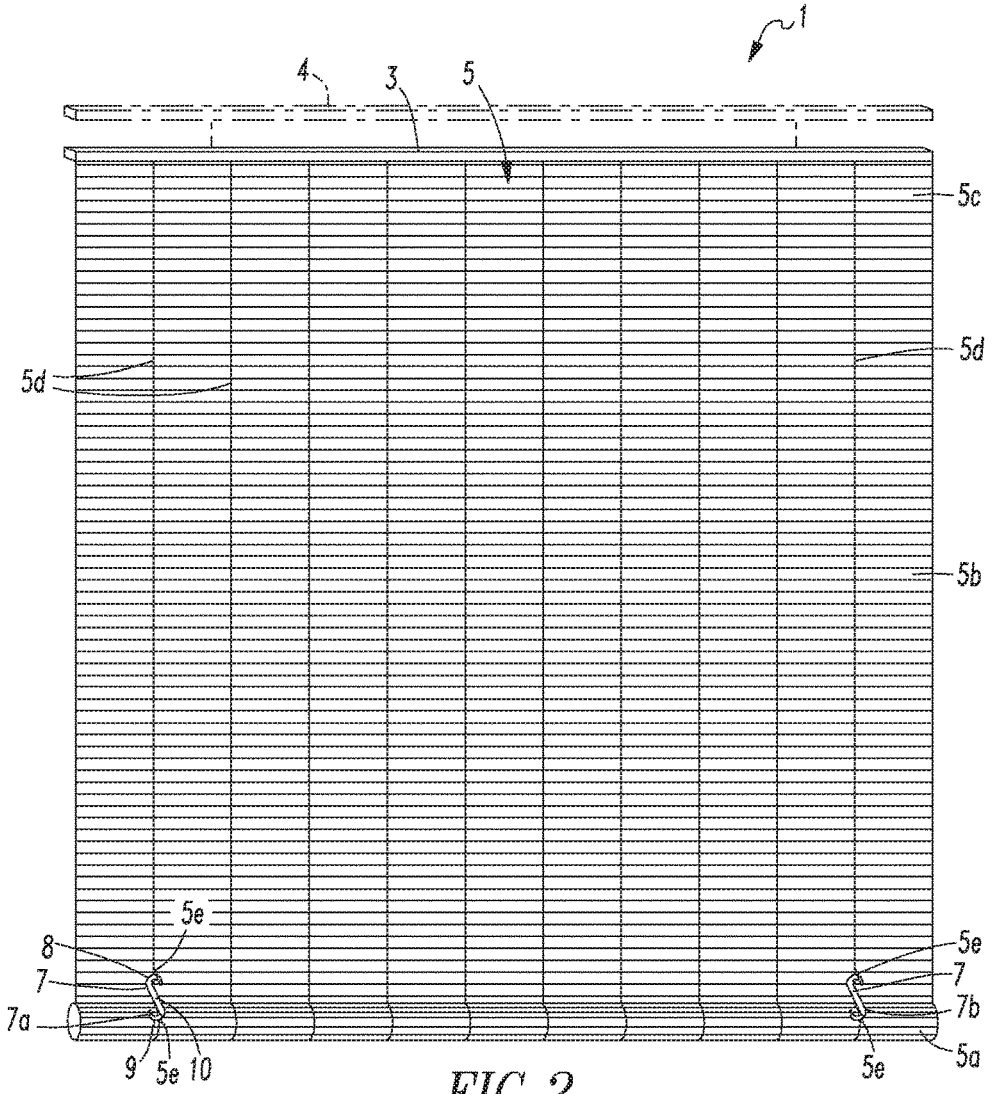
FIG. 2 is a perspective view of the first exemplary embodiment of the window covering with the window covering material in a second position.
Figure 6:
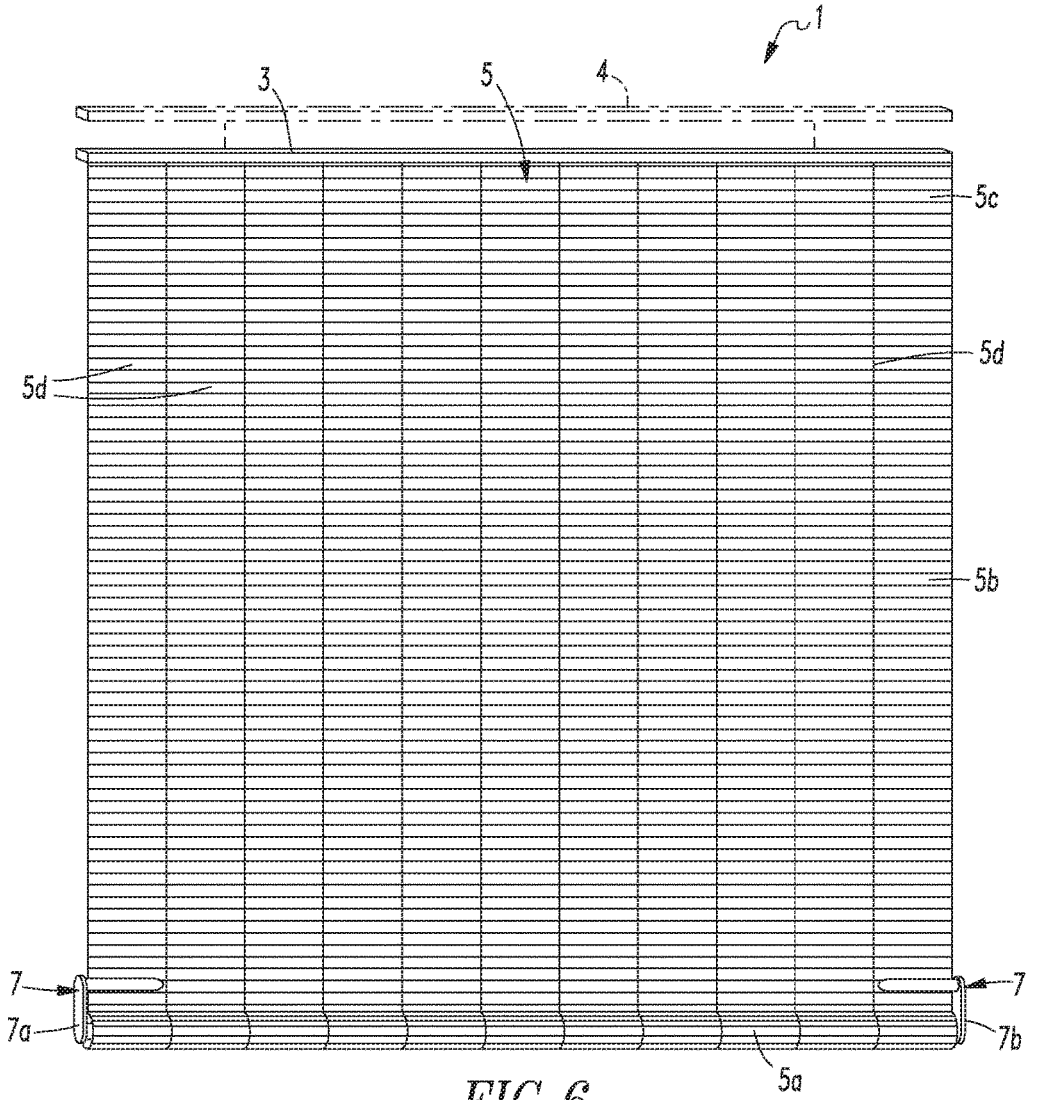
FIG. 6 is a perspective view of the second exemplary embodiment of the window covering with the window covering material in a third position that is located between first and second positions of the window covering material.
Figure 7:
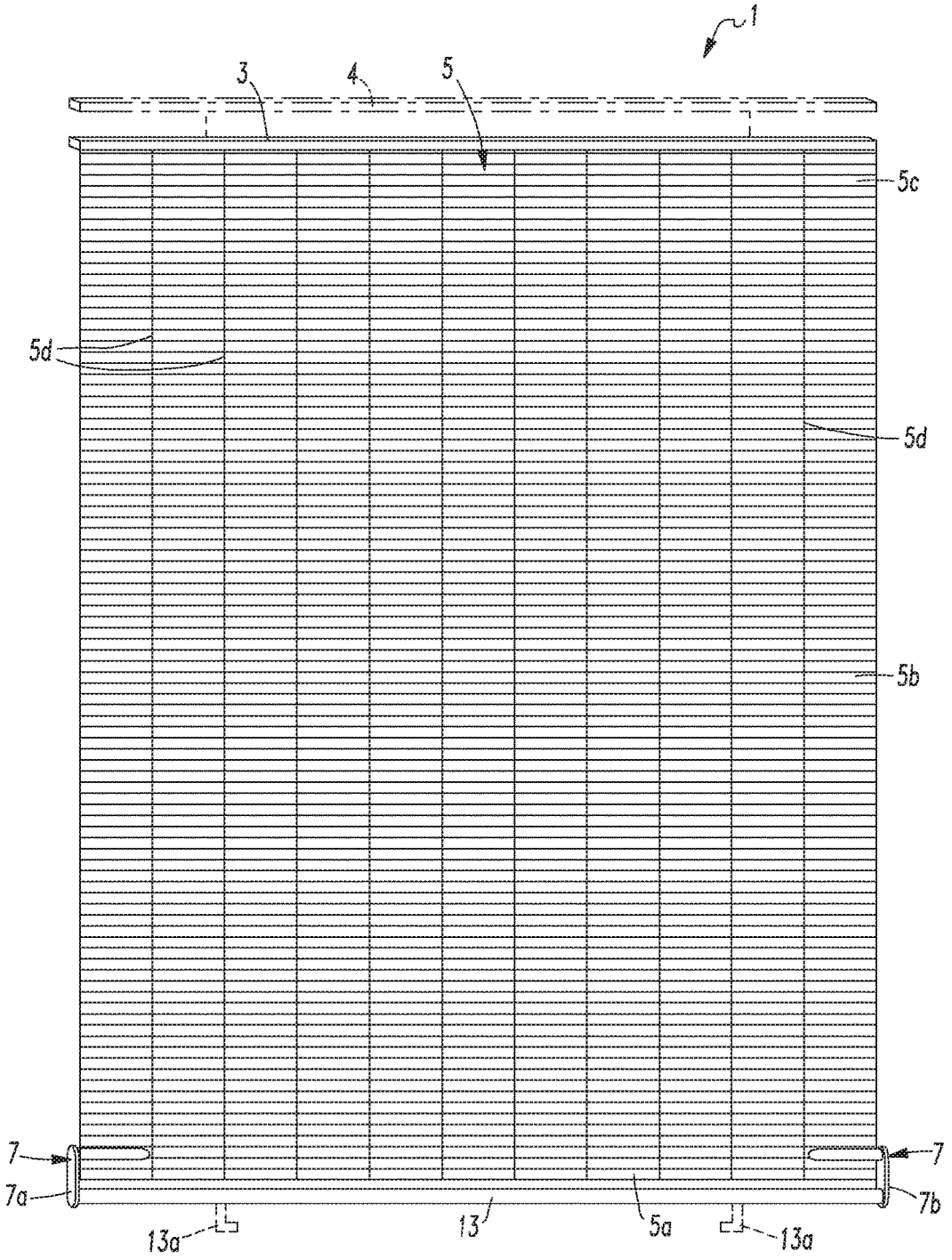
FIG. 7 is a perspective view of the second exemplary embodiment of the window covering with the window covering material in a second position.
Figure 21:
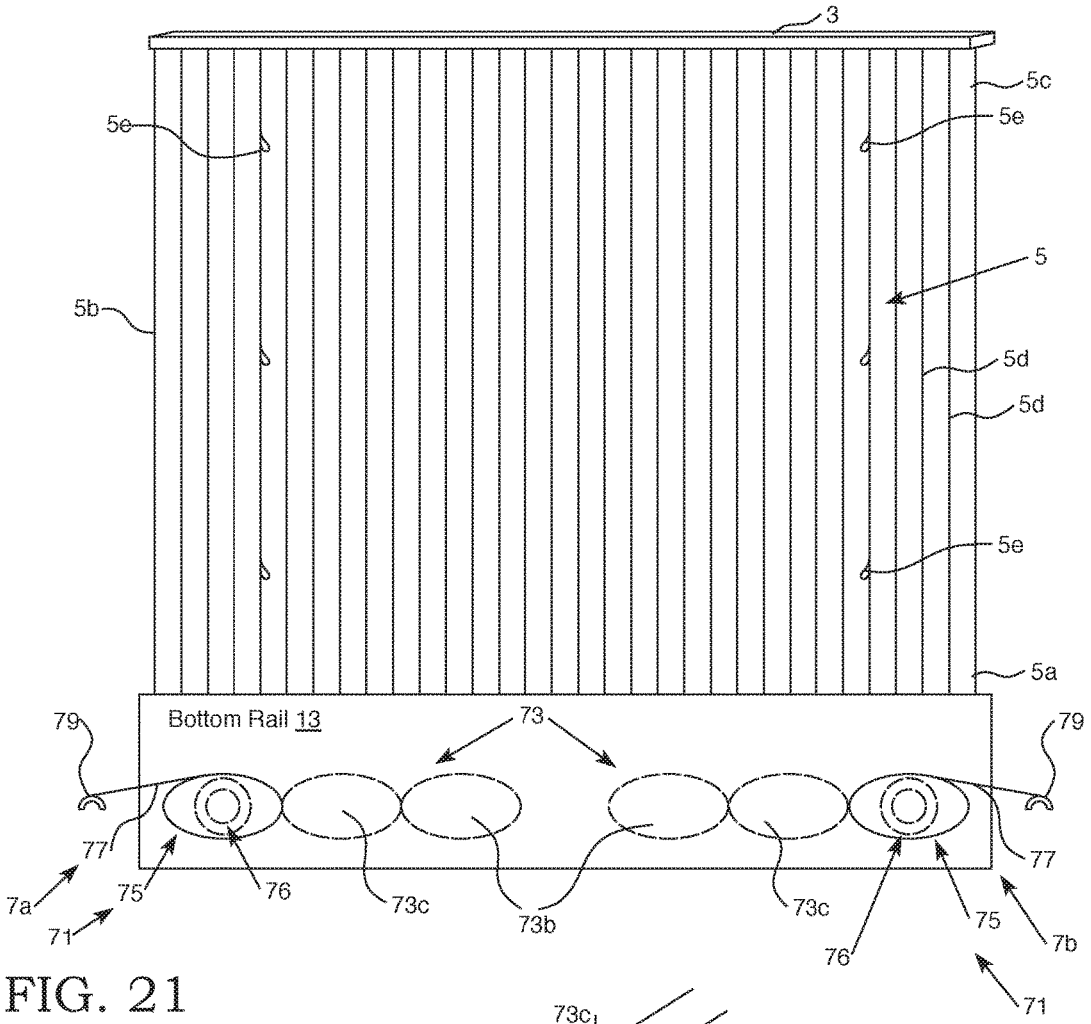
FIG. 21 is a schematic view of a sixth exemplary embodiment of the window covering illustrating an exemplary clip assembly of the sixth exemplary embodiment of the window covering with the window covering material in a first position and the exemplary clip assembly in a first position.

As can be appreciated from FIGS. 1-2, 5-7, and 13-23, the window covering material 5 can be moveable from a retracted position such as a position shown in FIG. 1, 5, 13, 15, 16, 17, or 18 to an extended position such as the positions shown in FIGS. 2, 7 and 21. The window covering material is also positionable between such positions, such as a third intermediate position. An example of such a third intermediate position located between fully extended and fully retracted positions is shown in FIG. 6. It should be appreciated that the window covering material 5 may be movable to permit adjustment of the window covering 1 from fully opened to fully closed.

The window covering material 5 may include a first lower portion 5*a*, a second intermediate portion 5*b* and a third upper portion 5*c*. The second intermediate portion 5*b* can be located between the first lower portion 5*a* and the third upper portion 5*c*. During the lowering or extending of the window covering material 5 from a retracted position to a lower position, the rolled up portion of the window covering material that can include the first lower portion 5*a* and second intermediate portion 5*b* can be unrolled so that the second intermediate portion 5*b* becomes unrolled and is no longer part of the lowered rolled up portion that includes the lower first portion 5*b* as the window covering material is lowered, or extended. The window covering material can also be raised from this position by rolling the window covering material 5 up from such a position to roll up the unrolled second intermediate portion 5*b* to return the window covering material to the retracted position such that the first lower portion and second intermediate portion are within the rolled up portion that is below the unrolled third upper portion 5*c*.

Alternatively, the window covering material 5 can be further lowered from such an extended position. For example, as can be appreciated from FIGS. 6-7, the window covering material 5 may be further extended by further unrolling of the rolled up first lower portion 5*a* that is below the unrolled second intermediate portion 5*b* so that the first lower portion 5*a* also become unrolled as the window covering material 5 is moved to a fully extended position. In this position, the first lower portion 5*a* may be fully unrolled as shown in FIG. 7 or may be only partially unrolled such that a portion of this material is still rolled up. For embodiments in which a bottom rail 13 is attached to the bottom edge of the window covering material 5, the bottom rail 13 may be positioned below the fully extended and unrolled window covering material 5. When the window covering material 5 is raised and begins to be rolled up, the window covering material may be rolled up around the bottom rail in multiple revolutions as the window covering material 5 is raised to the retracted position. This rolling up of the window covering material 5 may hide most, if not all, of the bottom rail 13 from view.

The raising and lowering of the window covering material may be performed by a user manually rolling up the window covering material or manually unrolling the window covering material. To keep the window covering material in a selected position, clips 7 can be utilized to maintain the position of the window covering material at a given position, such as the retracted position, fully extended position, or any intermediate position located between the fully retracted and fully extended positions. As may be appreciated from FIGS. 1-3, 5-13, 16-18, and 23, the clips 7 can extend from a lower portion of the window covering to an upper portion of the window covering located above a rolled up portion or bottom portion of the window covering 7 to hold the rolled up portion at a desired position. Use of the clips 7 can permit the position of the window covering material 5 to be maintained without the use of any lift cords or other lift cord control mechanisms such as a roller tube, spring motor unit, electric motor unit, loop cord drive, cord lock, or other type of lift cord control mechanism that may be coupled to lift cords.

The clips 7 can include use of a first clip 7*a* and a second clip 7*b* that are spaced apart from each other. In some embodiments, the first clip 7*a* may be positioned adjacent a first side of the window covering material 5 that extends from the bottom of the window covering material to the top of the window covering material and the second clip 7*b* may be positioned adjacent to a second side that extend from the top of the window covering material 5 to the bottom of the window covering material 5 that is opposite the first side. For instance, the first side may be the right side and the second side may be the left side or the first side may be the left side and the second side may be the right side. The top and bottom edges and the first and second sides of the window covering material 5 may define a rollable panel of window covering material that has a front face and a rear face that is opposite the front face when the window covering material is fully unrolled.

The first and second clips 7*a* and 7*b* may be releaseably connectable to the window covering material 5, or adjustably engageable with the window covering material to maintain the position of the window covering material in a selected position (e.g. retracted position, extended position, etc.). It is contemplated that some embodiments may utilize more than two clips 7 based on the width of the window covering material 5. It is also contemplated that some embodiments may only utilize only one clip 7, depending on the size of the window covering material 5 and structure of the clip 7.

The window covering material 5 may include a profile or a connector element at different locations along the window covering material 5 to permit the clips 7 to releaseably connect to the window covering material 5. For example, the window covering material 5 may be composed of woven wood, woven bamboo, or woven polymeric slats that are woven together via use of elongated members 5*d* that extend along the length of the woven material to connect different bamboo, wood, or polymeric slat segments together to form a rollable panel of material. In some embodiments, the elongated members 5*d* may be cords, ribbon, tape, or other elongated member. The elongated members 5*d* may extend from the first portion 5*a* to the third portion 5*c* of the window covering material 5. In fact, the elongated members 5*d* may extend along the entirety of the length of the window covering material 5 from the first rail 3 to the bottom rail 13 or from the top of the panel of window covering material 5 to the bottom of the panel of window covering material 5.

At least some of these elongated members 5*d* (e.g. at least one or at least two of the members 5*d*) can each include vertically spaced apart connectors 5*e* that are formed in the elongated member 5*d* or are attached to the elongated members 5*d*. The spaced apart connectors 5*e* can be positioned so that there are connectors 5*e* on the first, second, and third portions 5*a*, 5*b*, and 5*c* of the window covering material 5. The connectors 5*e* may be positioned in vertically aligned columns when the window covering material 5 is fully unrolled. For instance, there may be at least two columns of connectors 5*e* positioned on the window covering material where each column of connectors includes a plurality of spaced apart connectors 5*e*. Each connector in a column of connectors can be positioned on the window covering material to be parallel to a corresponding connector 5*e* in at least one other column of connectors 5*e* so that clips 7 can be attached to provide an even, balanced roll-up portion of window covering material at different selected positions.

The connectors 5*e* may be annular shaped structures such as rings, loops, or polygonal shaped annular structures. In other embodiments, the connectors 5*e* may be projections or projectable members that are coupled to the elongated members 5*d* and have a particular shaped profile (e.g. a hook profile configured to releaseably connect to a hook profile or other type of attachment profile of clip) or a slit profile configured to receive a button) or be structured as a snap, a button, or other type of connector feature. In yet other embodiments, the connectors 5*e* may be attached to other portions of a window covering material 5 or defined within the window covering material 5. For example, window covering material 5 that is composed of fabric may include certain structure woven into the fabric or attached to the fabric to define a connector for receiving a portion of a clip 7 to facilitate releasable attachment to that clip (e.g. button feature, snap feature, slit for receiving a button, loop or ring, etc.).

It should be appreciated that the geometry, size, and material of each clip 7 can be any of a number of designs for meeting a particular design objective and/or for use with a particular type of connector 5*e* that is attached or defined in the window covering material 5. For instance, in some embodiments, the clips 7 can include end portions that have attachment features for releasable connection to the spaced apart connectors 5*e* attached to the window covering material 5 or defined within the window covering material 5. For example, the clips 7 can include a body having opposite first and second ends that each have an attachment feature defined on the ends or attached to those ends for releasable attachment with connectors 5*e*. The body of each clip can space apart the attachment ends (or attachment sides) of the clip to permit the lower rolled-up portion of window covering material to be held by the unrolled portion of the window covering material above the rolled-up portion when the clip is attached to both the lower rolled up portion and upper unrolled portion of the window covering material and extends between those portions. For example, the opposite ends or sides of the clips 7 may include buttons, male snap elements for mating with female snap connectors on the window covering material 5, female snap elements for mating with male snap connectors on the window covering material, slits for receiving buttons attached to the window covering material (e.g. button sewn on or otherwise attached to the window covering material), or have another type of feature such as a hook profile or other type of attachment profile that may be releaseably coupled to loops, rings, or other type of connector 5*e*.

The bottom rail 13 can include one or more holders 13*a*, which are shown in broken line in FIG. 7. Each holder 13*a* can be configured to hold one or more of the clips 7 when the window covering material 5 is fully unrolled and the window covering is in the fully lowered, fully extended, or fully open position. Each holder 13*a* can be configured as a loop, a ring, a hook, or other type of holder.

In some embodiments, each holder 13*a* may be a particular aperture or shape defined within a sidewall of the bottom rail 13. In other embodiments, each holder may be attached to the bottom rail via a fastener or other type of attachment mechanism. For instance, it is contemplated that the each holder 13*a* may be attached to the bottom rail 13 and be configured to include the same attachment feature as a connector 5*e* or may have a similar attachment feature as a connector 5*e*.

As another example, it is contemplated that the bottom rail 13 can be composed of a magnetic metal and the clips 7 can include a magnetic element that is configured to be attracted to the bottom rail 13 for releasable attachment to the bottom rail 13 via the magnetic attraction between the sidewall of the bottom rail 13 and the magnetic element included in a portion of the clip 7. In yet other embodiments, a magnetic element that is configured to attract a magnetic element within or on a portion of each clip can be positioned within the bottom rail or on the bottom rail 13 for holding the clips 7 to the bottom rail 13 via the magnetic attraction between these magnetic elements. For instance, magnets may be positioned in or on the bottom rail and the clips can include ferromagnetic elements that are attracted to those magnets. As another example, the clips 7 can each include a magnet and the bottom rail 13 may be composed of a ferromagnetic material or include one or more ferromagnetic elements for releasable attachment to the magnets of the clips.

Figure 3:
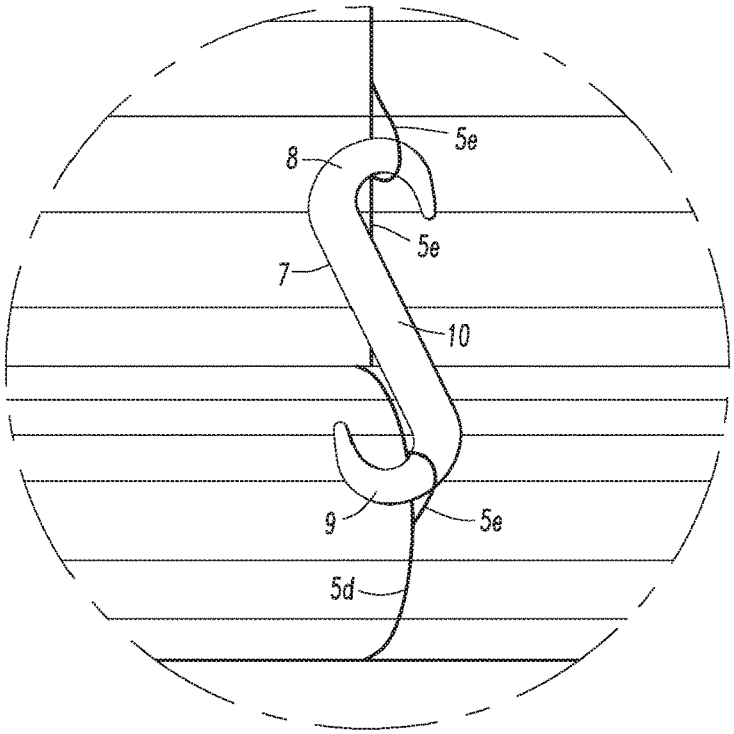
FIG. 3 is a perspective view of one of the clips of the first exemplary embodiment of the window covering.
Figure 4:
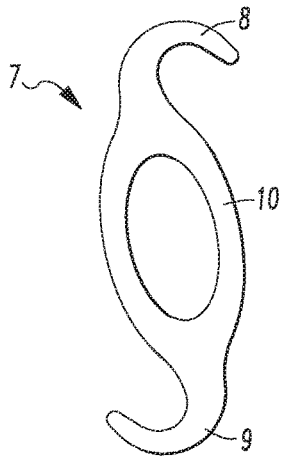
FIG. 4 is a perspective view of an alternative embodiment of a clip that may be used as a clip of the first exemplary embodiment of the window covering.
Figure 5:
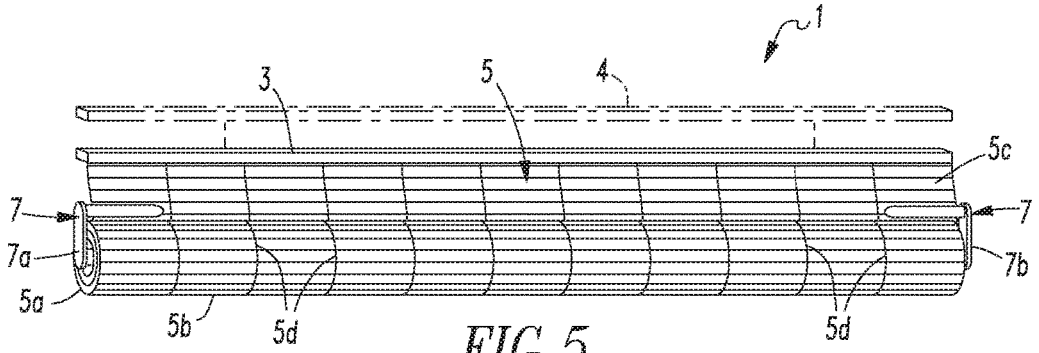
FIG. 5 is a perspective view of a second exemplary embodiment of the window covering with the window covering material in a first position.

Referring to FIGS. 3-4, some exemplary embodiments of the clips 7 can include a first hook end 8 and a second hook end 9 that is opposite the first hook end 8. The first and second hook ends 8 and 9 can be configured as hook members in some embodiments. An intermediate body 10 can extend between the first hook end 8 and the second hook end 9. For instance, the intermediate body 10 can be a linearly extending body that has a cylindrical or polygonal cross section. The intermediate body 10 could be of a uniform thickness or have a varying thickness. Each clip may be molded from a polymeric material or be composed of another type of material (e.g. wood or metal). Each clip may be molded as a unitary single piece. In other embodiments, each clip may be formed by fastening multiple components together to form the structure of the clip 7. In other embodiments, the body 10 and the first and second hook ends 8 and 9 of the clips 7 can be any of a number of geometries, sizes, and configurations to meet a particular design objective or to provide releasable attachment to connectors 5*e* positioned on the window covering material 5. In some embodiments, the hook ends may be alternatively configured to include buttons, snap elements, or other releasable attachment profile or releasable attachment connector element.

Each of the clips 7 can be configured so that a first hook end 8 is attached to the upper unrolled portion of the window covering material 5 and the second hook end 9 can be attached to the lower rolled up portion of the window covering material so that the clip extends between the upper unrolled portion and lower rolled up portion to maintain the position of the rolled up portion of the window covering material 5. For example, as can be seen from FIGS. 1-3, the first hook end 8 of each clip 7 can be releaseably attached to the third upper portion 5*c* of the window covering material 5 and the second hook end 9 can be releaseably attached to the rolled up portion of the window covering material 5, such as to the second intermediate portion 5*b* or the first lower portion 5*a* of the rolled up portion of the window covering material when the window covering material 5 is in the retracted position. As another example, the first hook end 8 may be releaseably attached to the second intermediate portion 5*b* of the window covering material and the second hook end 9 may be releaseably attached to the first lower portion 5*a* that is rolled up when the window covering material is positioned in an extended position such as the position shown in FIG. 2. Such positioning of the clips 7 can allow each of the clips to extend from adjacent the rolled up portion to the unrolled portion above the rolled up portion to maintain the position of the rolled up portion and thereby maintain the position of the window covering material 5. When hooked or otherwise attached to the window covering material via the first and second hook ends 8 and 9, the clips 7 are able to engage the unrolled portion of the window covering material to prevent the rolled portion to unroll via gravity.

To change a position of the window covering material, the clips 7 can each be fully unhooked or otherwise decoupled from the window covering material. The window covering material may then be rolled up further to raise the window covering 1 or may be unrolled further to lower the window covering 1. After the window covering material is at a desired position, the clips 7 may then be reattached to the window covering material 5 via their first and second hook ends 8 and 9 so that the clips 7 extend from the rolled up portion to an unrolled portion located above the rolled up portion. Each hook end of each clip may be configured to be hooked to a portion of the window covering material by piercing through a portion of the material or by hooking on to a portion of the material (e.g. a portion of woven wood or woven bamboo, or piercing a sheet of fabric, etc.). During the positioning of the clips 7, a second user may hold the window covering material in position or a tool may be utilized to help keep the window covering material rolled up at the selected position until the clips are sufficiently attached.

Referring to FIGS. 5-9, the clips 7 could have an alternative structure that is configured for attachment to a bottom rail 13 or a bottom element of the window covering material (e.g. a bottom slat of a sheet of material that is within the window covering material 5 or another type of bottom element positioned within the window covering material 5 or attached to the bottom of the window covering material 5, etc.). For example, the clips 7 can each include a body 20 having a lower first end that is configured for attachment to a bottom rail 13 or other element adjacent the bottom of the window covering material. The body can extend upwardly from its lower first end which may be positioned adjacent the bottom rail 13 and/or bottom portion of window covering material to a second end that may be located above its first end adjacent to an upper unrolled portion of window covering material 5. The second end may have moveable prongs 14 and 16 that are spaced apart from each other to define a gap, channel, or other type of opening 18 that is sized to receive unrolled window covering material 5 therein so that the prongs 14 and 16 can engage opposite front and rear faces of the unrolled portion of the window covering material 5 that may be above a rolled up portion to maintain the position of the rolled up portion and thereby also maintain the position of the window covering material to a user selected location between the fully extended and fully retracted positions of the window covering material 5.

Figure 8:
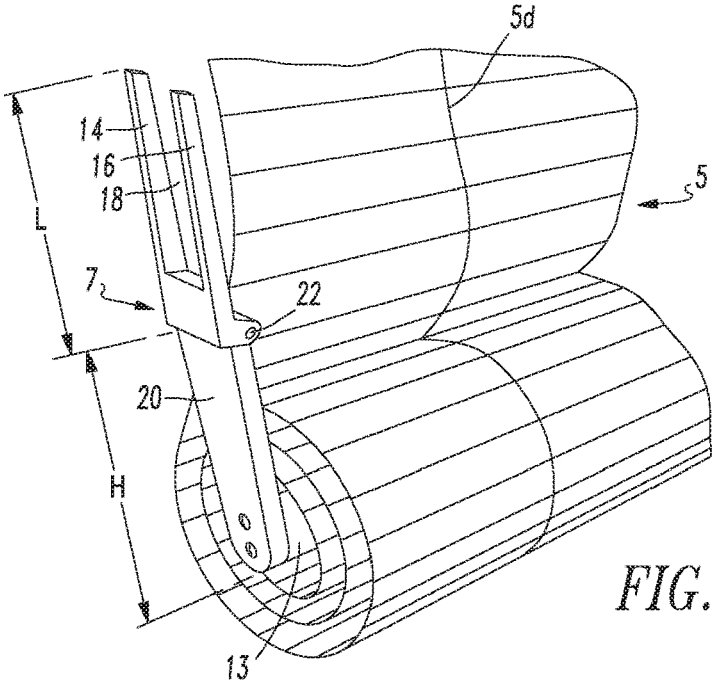
FIG. 8 is a fragmentary view of the second exemplary embodiment of the window covering illustrating an exemplary clip of the second exemplary embodiment of the window covering in a disengaged position.
Figure 9:
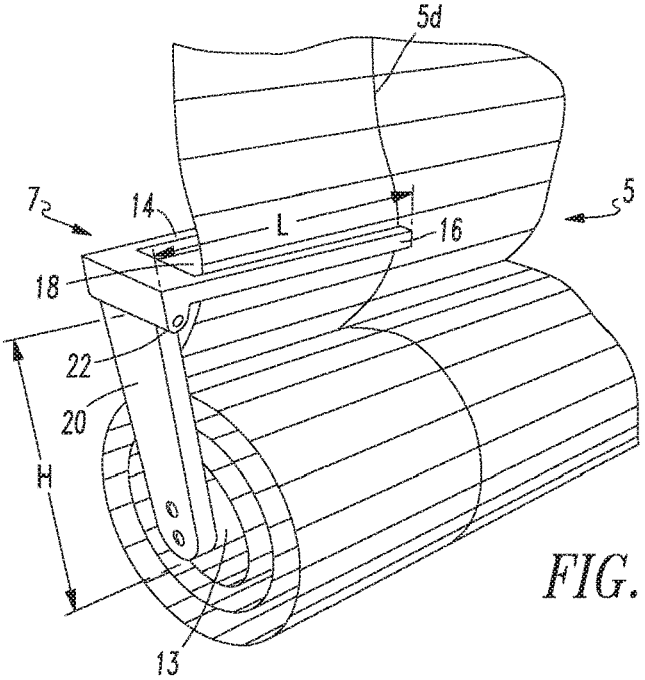
FIG. 9 is a fragmentary view of the second exemplary embodiment of the window covering illustrating the exemplary clip of the second exemplary embodiment of the window covering in an engaged position.
Figure 10:
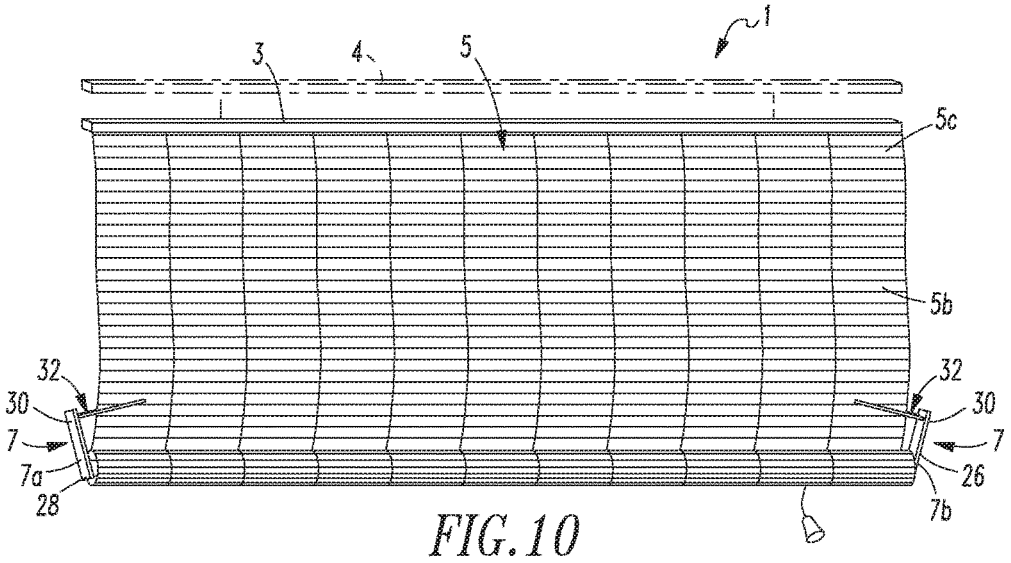
FIG. 10 is a perspective view of a third exemplary embodiment of the window covering.
Figure 11:
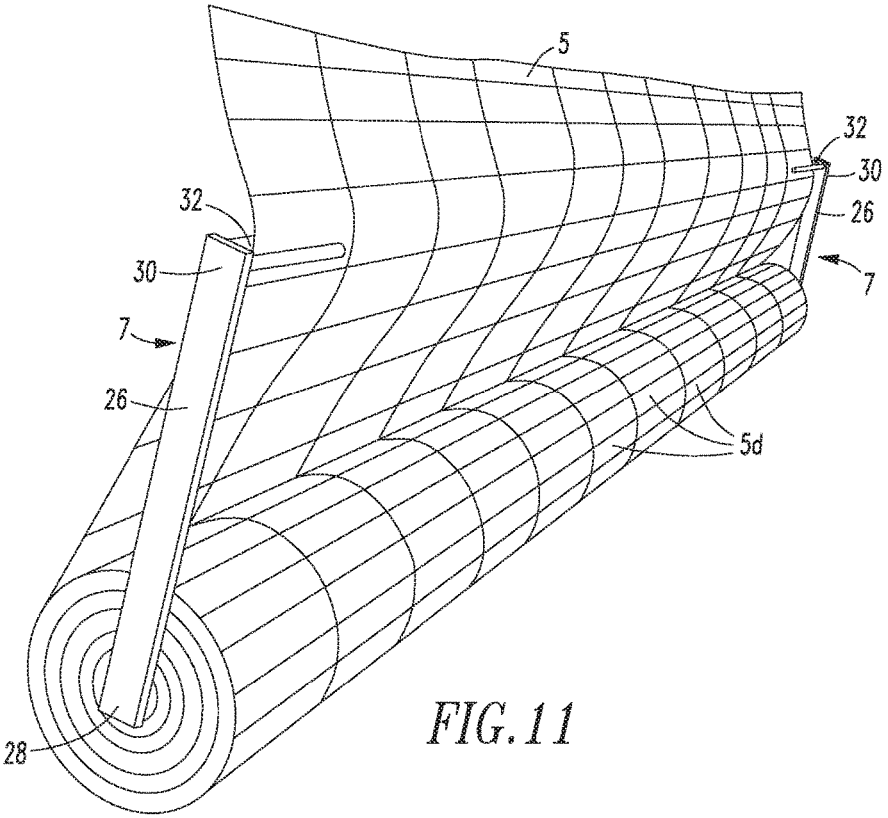
FIG. 11 is a fragmentary view of the third exemplary embodiment of the window covering illustrating an exemplary clip of the third exemplary embodiment of the window covering.
Figure 12:
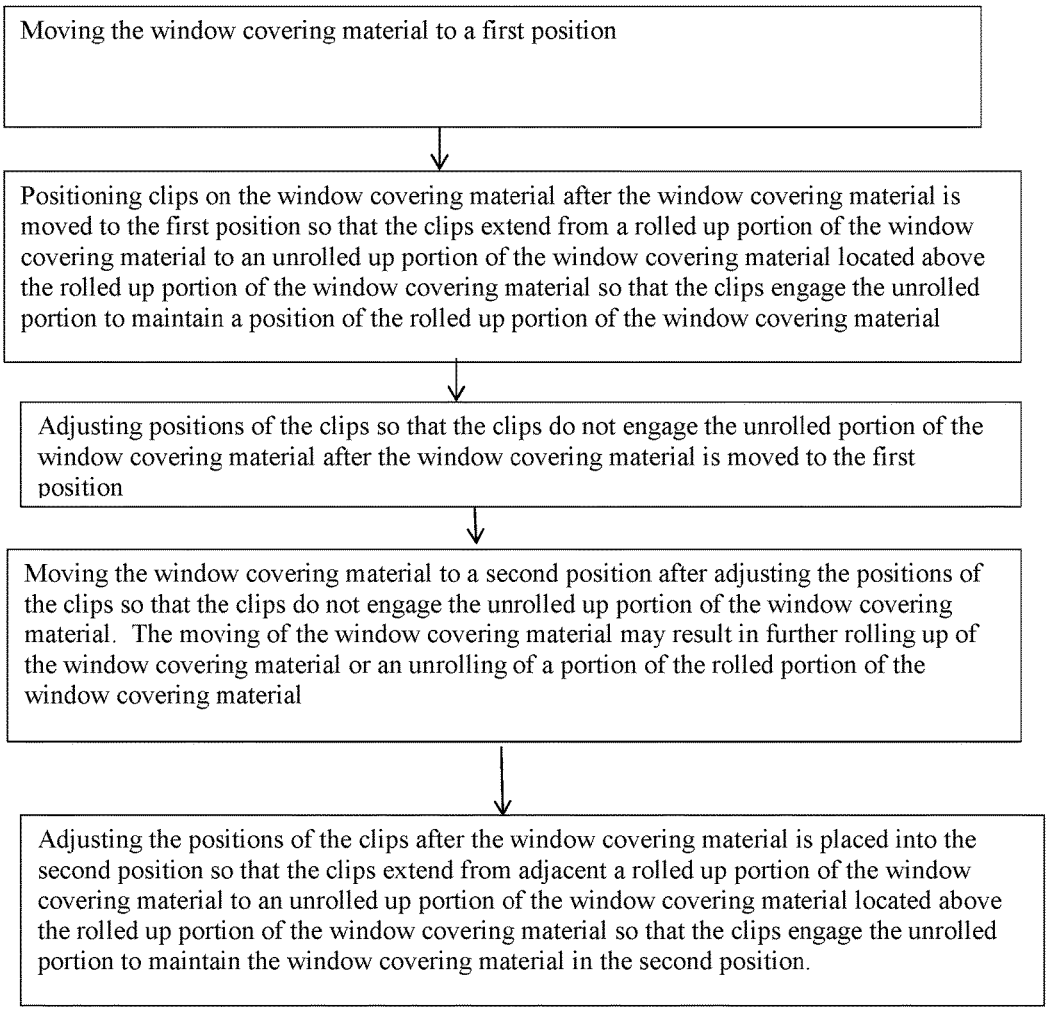
FIG. 12 is a flow chart illustrating an exemplary method of adjusting a position of a window covering.
Figure 13:
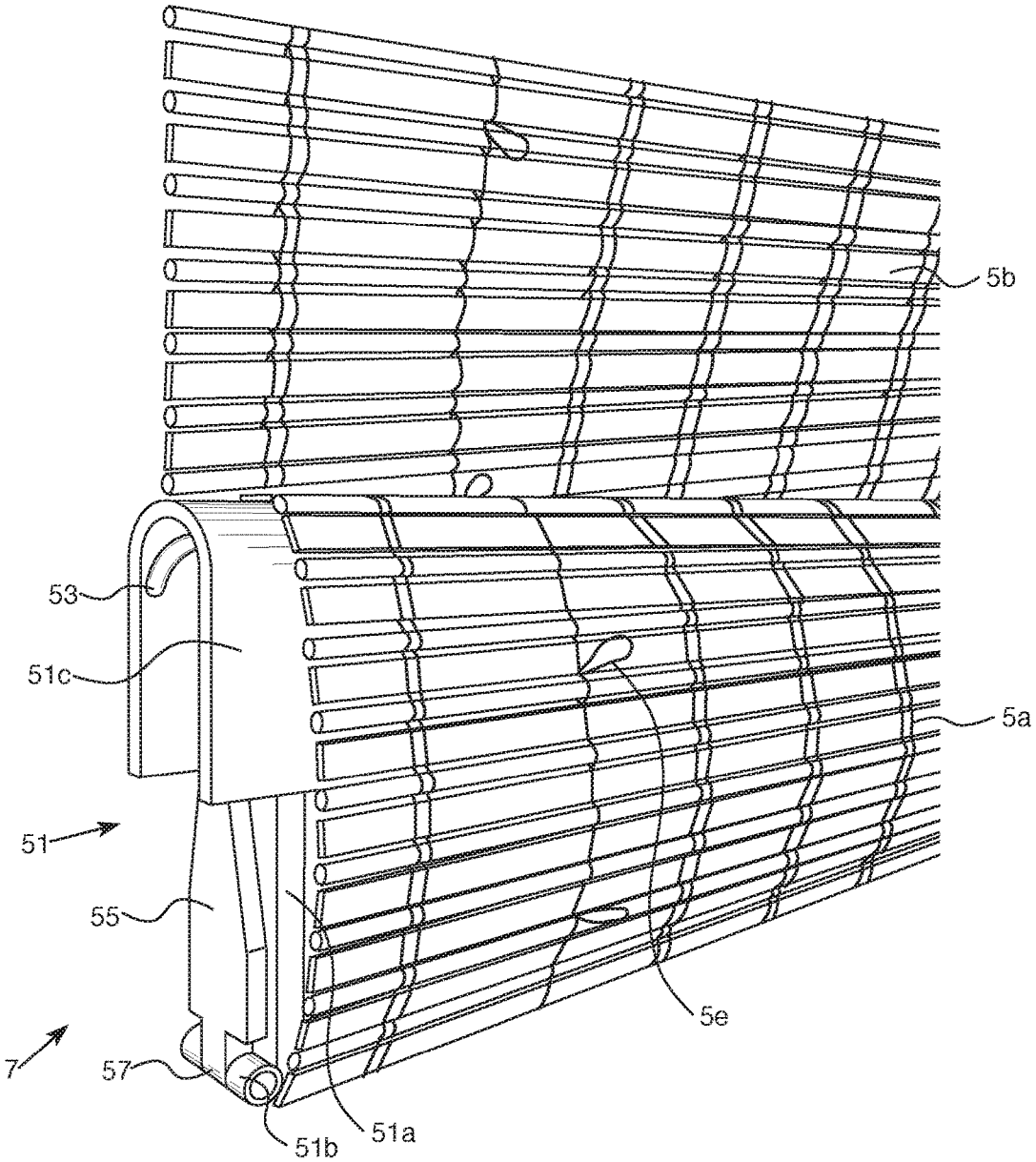
FIG. 13 is a fragmentary perspective view of a fourth exemplary embodiment of the window covering illustrating an exemplary clip of the fourth exemplary embodiment of the window covering with the window covering material in a first position and the exemplary clip in a first position.
Figure 14:
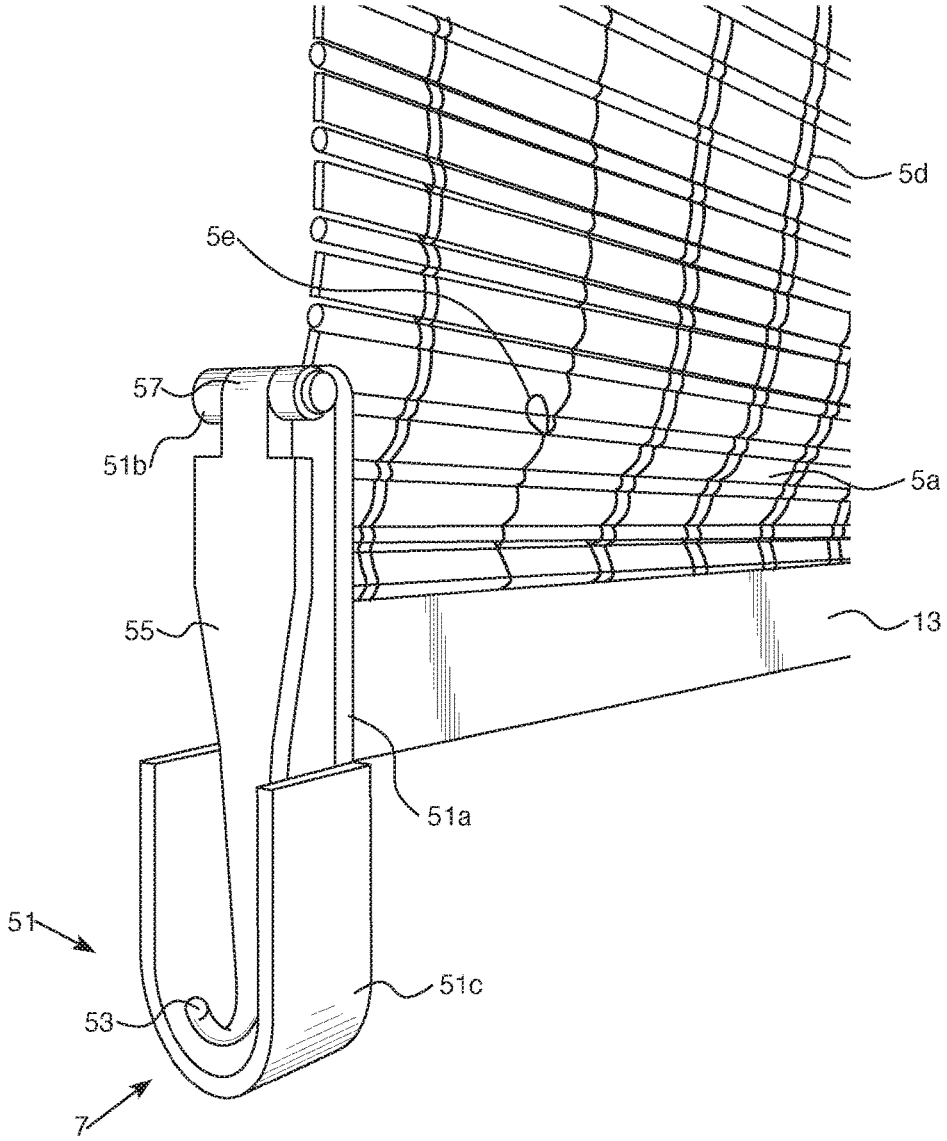
FIG. 14 is a fragmentary perspective view of the fourth exemplary embodiment of the window covering illustrating an exemplary clip of the fourth exemplary embodiment of the window covering with the window covering material in a second position and the exemplary clip in the first position.
Figure 15:
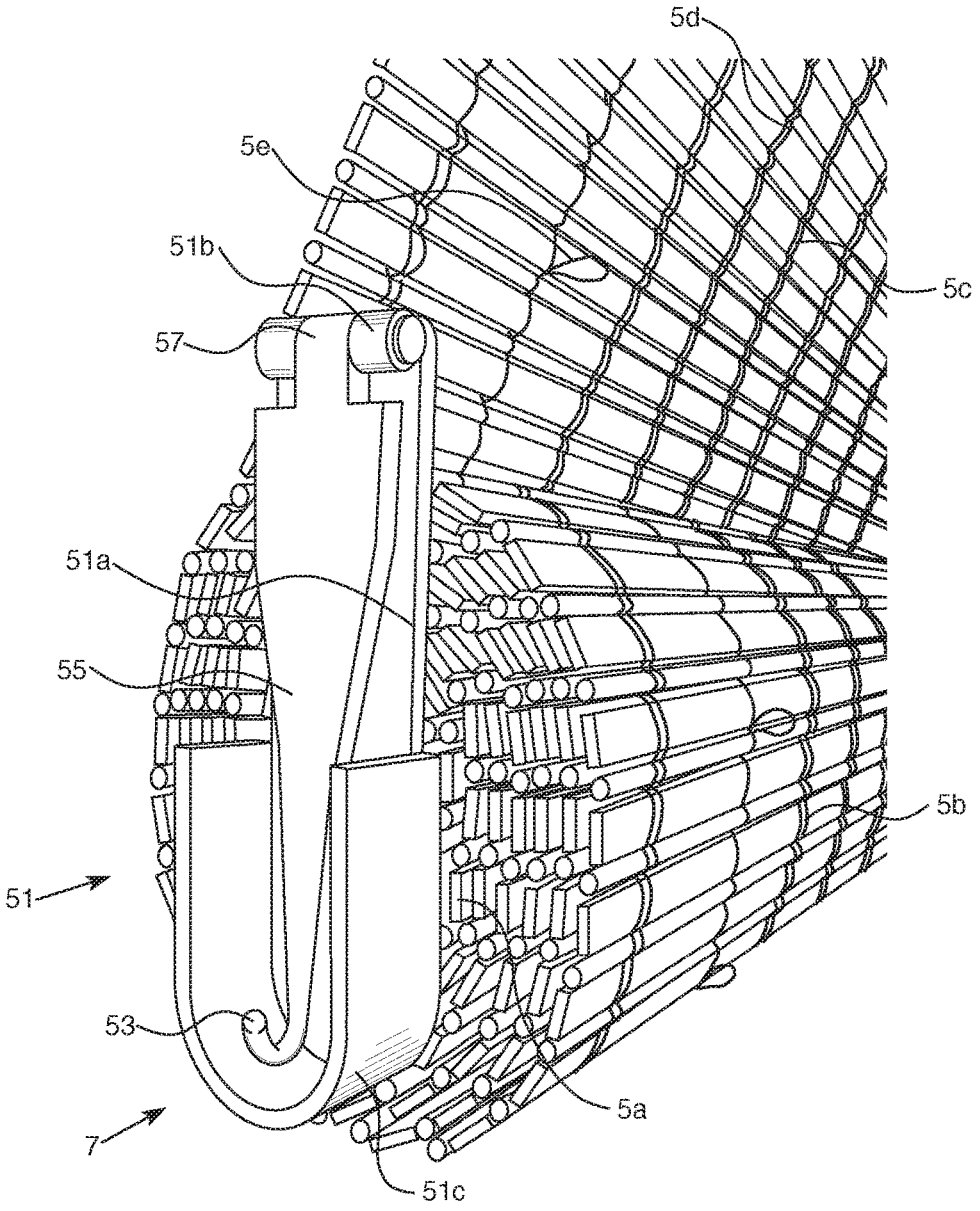
FIG. 15 is a fragmentary perspective view of the fourth exemplary embodiment of the window covering illustrating an exemplary clip of the fourth exemplary embodiment of the window covering with the window covering material in a third position and the exemplary clip in the first position.

The prongs 14 and 16 may be considered first and second prongs. These prongs 14 and 16 may be part of a unitary structure that is moveably coupled to the body 20 of the clip 7 by a moveable attachment mechanism 22 to permit the prongs to be moveable from a disengaged position as shown in FIG. 8 to an engaged position as shown in FIG. 9. The moveable attachment mechanism 22 can include, for example, a pivotal connector for connecting the prongs to the body 20 so that the prongs 14 and 16 are moveable between the engaged and disengaged positions. In the engaged positions, the prongs 14 and 16 may be in contact with or otherwise engaging the window covering material. In the disengaged positions, the prongs may be moved away from the window covering material sufficiently to be disengaged from the material to permit the window covering material to be unrolled or further rolled up. In some embodiments, the prongs may be configured to move adjacent to the body 20 so that ends (e.g. hook members or other type of distal ends) of the prongs are positioned adjacent the body 20 when the prongs are in the disengaged position and are move further away from the body 20 to extend away from the body and to engage the window covering material when moved to their engaged positions.

The pivotal connector can include a pin that extend through the body 20 to which the prongs 14 and 16 are moveable attached. The pin can define an axis of rotation about which the prongs are moveable (e.g. a horizontal axis or a substantially horizontal axis that is within 10° of being horizontal). In other embodiments, the moveable attachment mechanism 22 could be another type of moveable connector such as a ball and socket joint connector or another type of moveable connector.

In some embodiments, the prongs 14 and 16 may extend linearly along their length L to be transverse (e.g. perpendicular or substantially perpendicular (e.g. within 10° of perpendicular) to the height H of the body 20 of the clip 7 when in the engaged position and may extend linearly along their length vertically to be parallel or substantially parallel to the height H of the body 20.

The height H of the body 20 can be considered the dimension at which the body 20 extends vertically from its first end to the prongs 14 and 16. The length L of the prongs can be understood to be the largest dimension that the prongs extend. It is contemplated that the width and thickness of prongs 14 and 16 will typically be smaller than their length L. When the prongs 14 and 16 are in the disengaged position, the length L of the prongs could be considered the height of the prongs.

The prongs 14 and 16 that define opening 18 in each clip 7 could alternatively be configured to be non-moveably affixed to the body 20. For instance, referring to FIGS. 10-11, the clips 7 could alternatively be structured to have a body 26 having a first end 28 that is configured for releasable attachment to a bottom rail 13 or affixation to a bottom rail 13 and a second end 30 having immovable prongs 30 affixed thereto. The prongs 30 can be spaced apart to define an opening 32 that is sized to receive a portion of unrolled window covering material so that the prongs are able to engage the opposite faces of the window covering material within the opening 32. The body 26 can be configured so that user may grasp the body 26 and/or prongs 30 to pull the prongs and body 26 away from the sides of the window covering material via deformation (e.g. bending or flexing) of the body 26 so that the prongs 30 no longer engage the window covering material 5 or no longer have the window covering material received within their openings 32. The user may then provide an upward force to raise the rolled up portion of window covering material 5 to further roll up the window covering material 5 upon raising of the window covering material 5 to a further retracted position or permit the rolled up portion to further unroll to further lower the window covering material to a further extended position. Once the window covering material 5 is in a desired location, the user may permit the body 26 to move back toward the side of the widow covering material at which the clip 7 of that body 26 is positioned so that an unrolled portion of the window covering material is received within the openings 32 of the clips 7 to engage that material and maintain the position of the window covering material. Further readjustment of the position of the window covering material 5 may occur in the same way.

For the embodiment of the window covering having clips 7 as shown in FIGS. 5-11, the manual user-driven motion of the clips 7 may move the prongs 30 of the clips 7 or prongs 14, 16 of the clips 7 from engaged positions in which the prongs contact unrolled window covering material received within openings to disengaged positions at which the prongs do not contact the window covering material 5. Such movement of the prongs can be from a user grasping each clip 7 with a respective hand and pulling the clips 7 in opposite directions (e.g. move one clip left and the other clip right via deformable/resilient body 26 or pivoting each clip from its engaged position to its disengaged position via moveable attachment mechanism 22) to move the clips 7 away from each other and away from the left and right sides of the window covering material 5 adjacent to which they may be positioned to disengaged positions. After being moved to their disengaged positions, the user may subsequently pull the clips 7 upwards to roll up more of the window covering within the rolled up portion during raising of the window covering material 5 or allow the clips 7 to move lower via gravity to unroll some of the rolled up portion of the window covering material 5 to adjust the position of the window covering material 5. Once at the window covering material 5 is manually adjusted or moved to the desired position, the user may allow the clips 7 to move back toward the window covering material 5 by moving toward each other so the prongs 30 of the clips 7 are moved back to engaged positions for contacting opposite faces of the unrolled portion of the window covering material to maintain the window covering material 5 at the new user selected position. Subsequent readjustment of the window covering material 5 can also be effected by a user in a similar manner.

Figure 16:
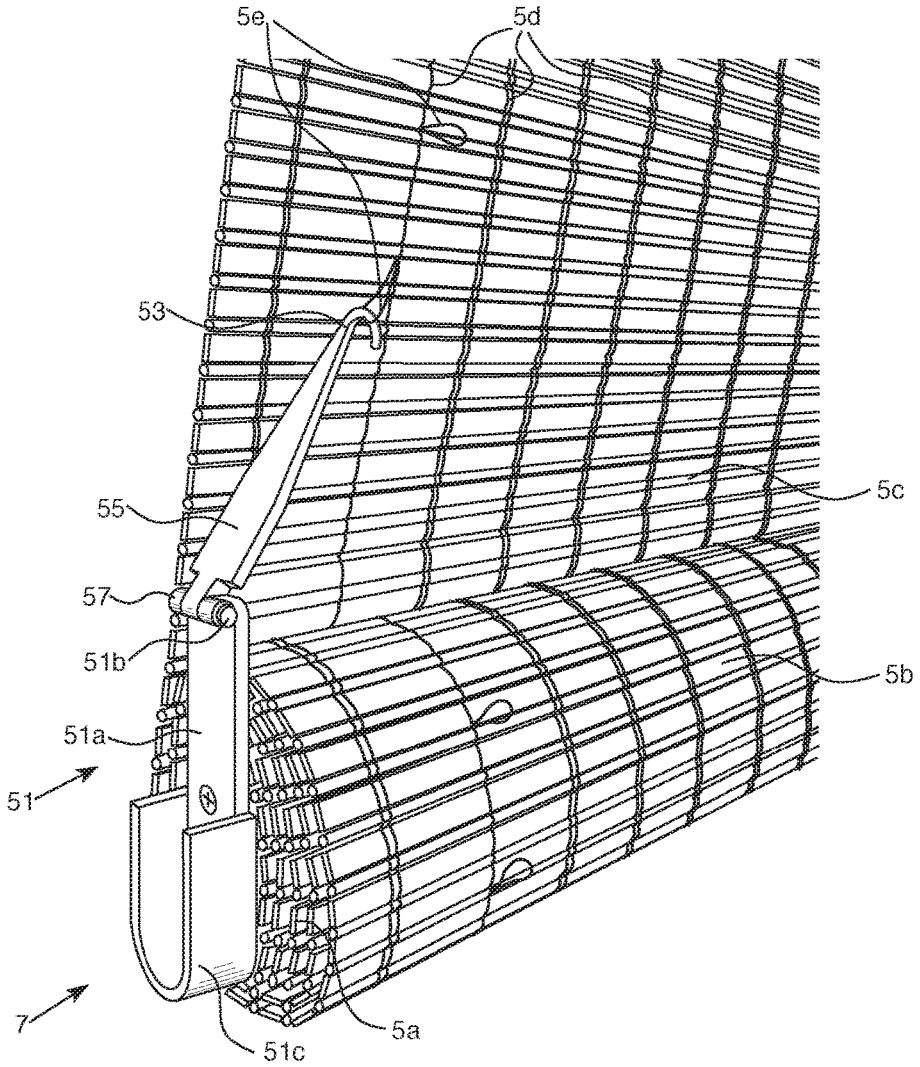
FIG. 16 is a fragmentary perspective view of the fourth exemplary embodiment of the window covering illustrating an exemplary clip of the fourth exemplary embodiment of the window covering with the window covering material in the third position and the exemplary clip in a second position.
Figure 17:
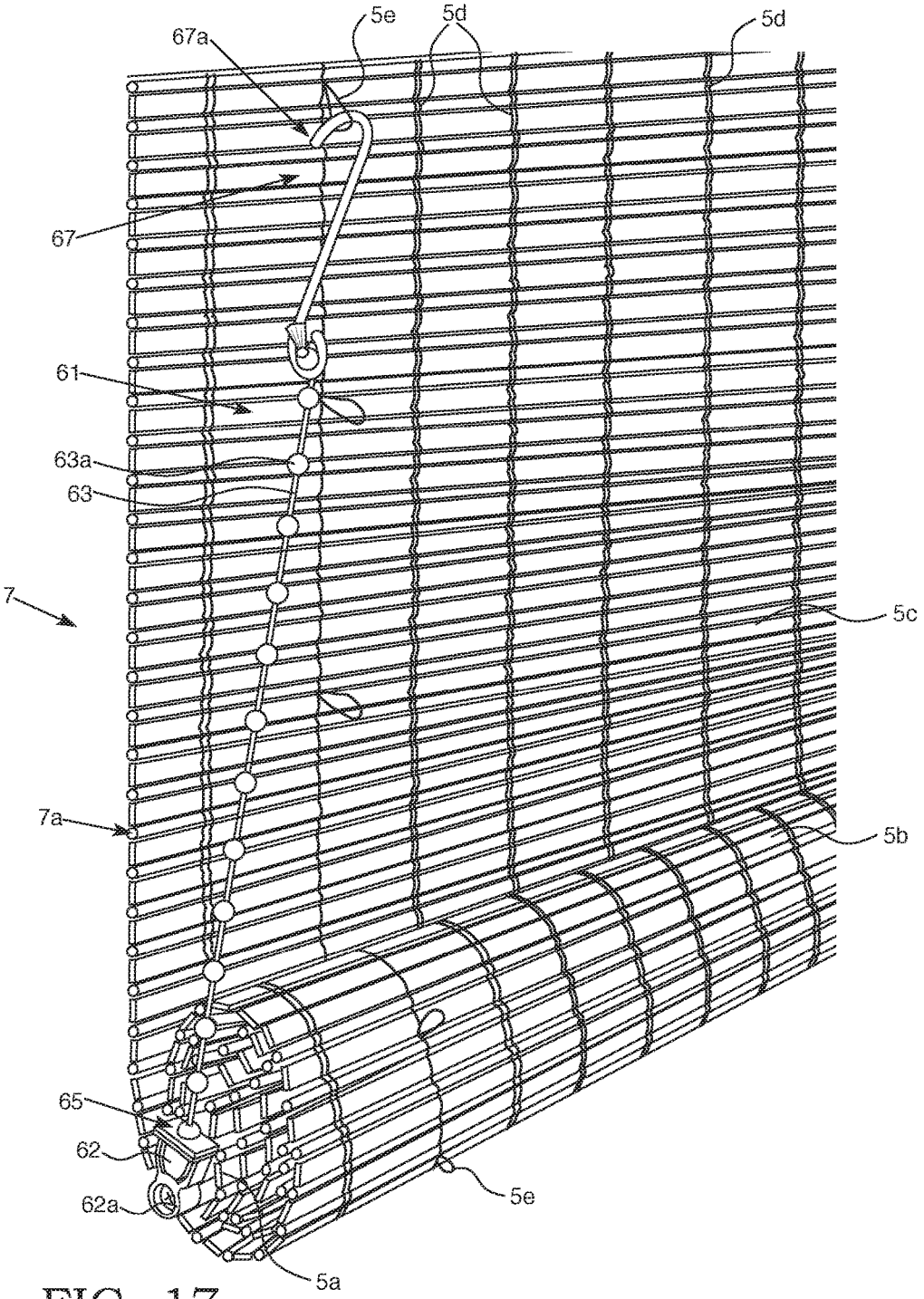
FIG. 17 is a fragmentary perspective view of a fifth exemplary embodiment of the window covering illustrating an exemplary clip of the fifth exemplary embodiment of the window covering with the window covering material in a first position and the exemplary clip in a first position.
Figure 18:
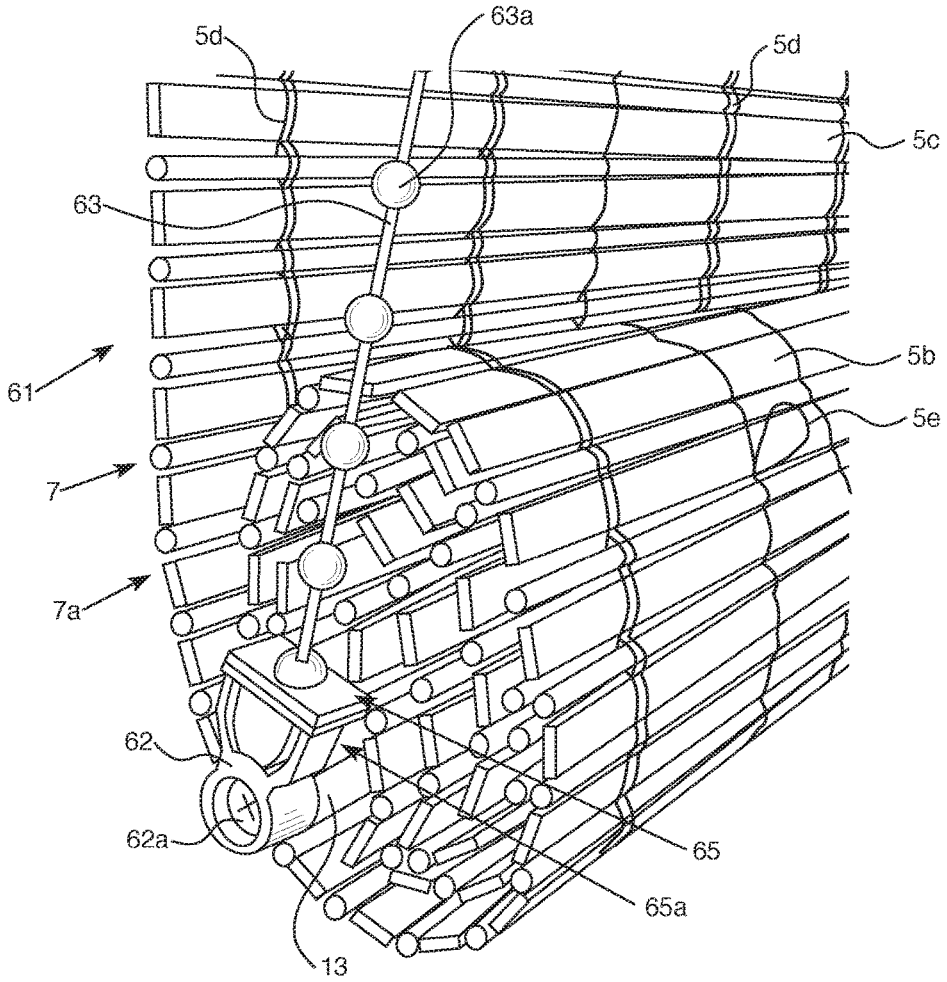
FIG. 18 is an enlarged fragmentary perspective view of the fifth exemplary embodiment of the window covering illustrating an exemplary clip of the fifth exemplary embodiment of the window covering.
Figure 19:
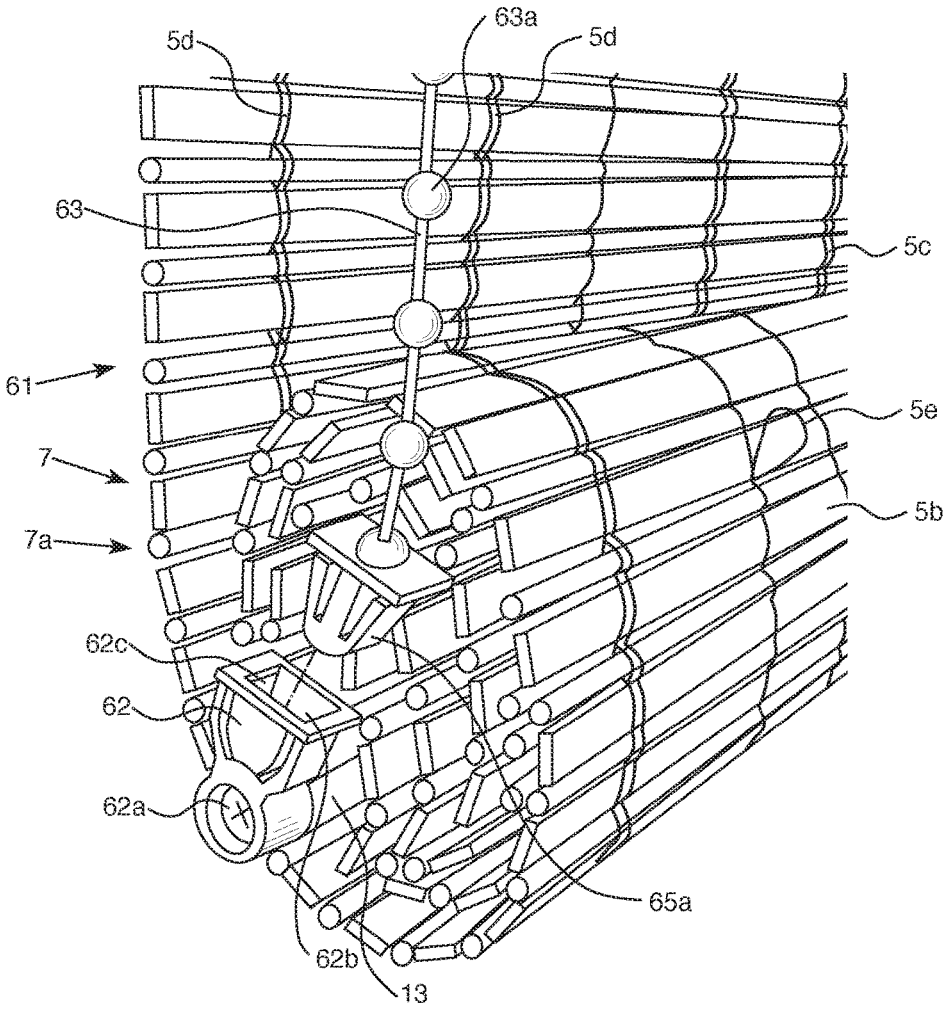
FIG. 19 is a view similar to FIG. 18 illustrating the exemplary clip of the fifth exemplary embodiment of the window covering in a second position.
Figure 20:
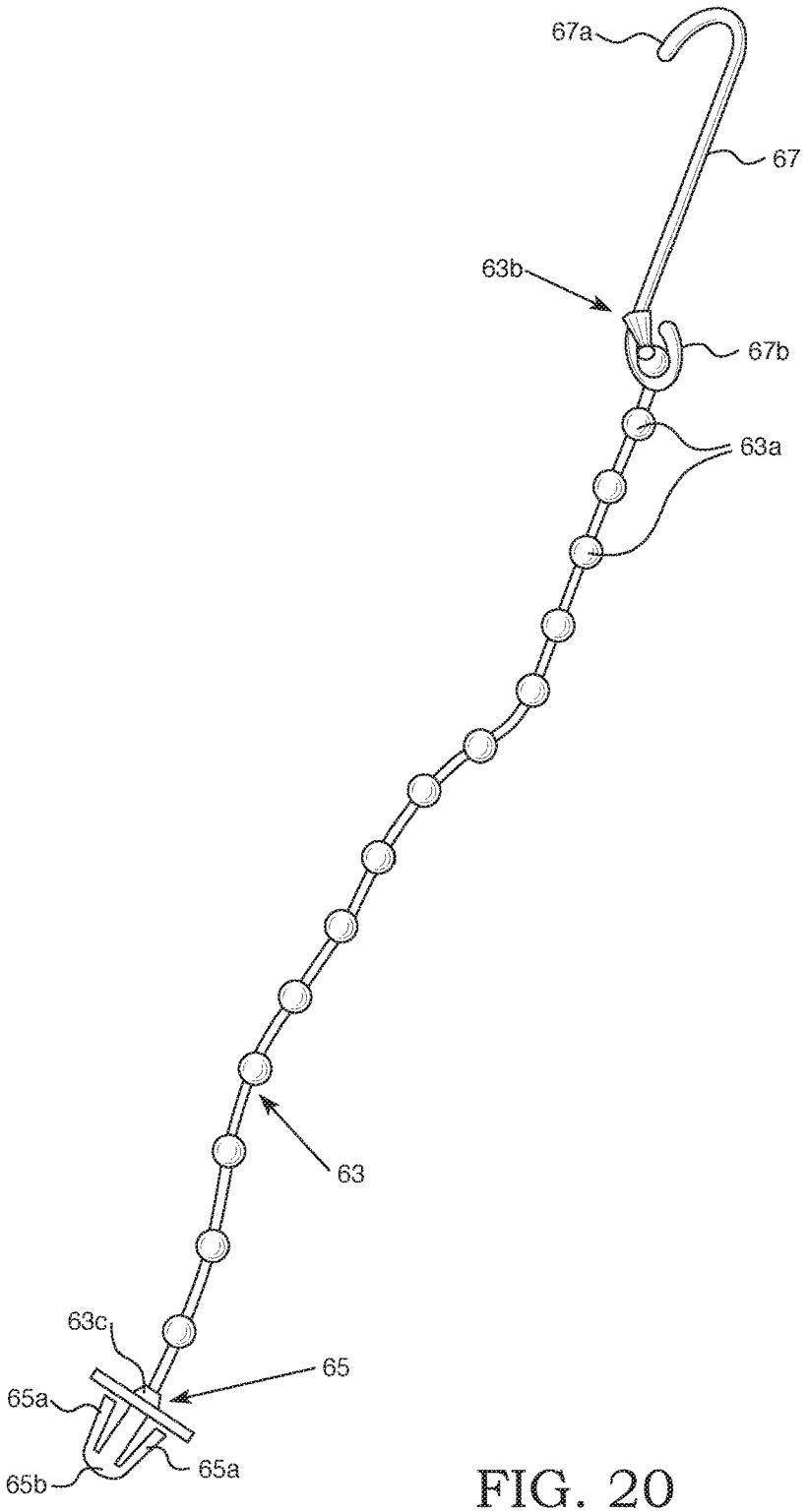
FIG. 20 is a perspective view of a portion of the exemplary clip of the fifth exemplary embodiment of the window covering that is separable from another portion of the clip when the clip is in its second position.

Referring to FIGS. 13-16, embodiments of the clips 7 can be configured as clip assemblies that are each configured to have an extendable hook 53 that may be moved from a retracted position to an extended position. Each hook 53 can be configured as a hook member for the clip 7 or clip assembly of that hook 53 so that the clips can extend from adjacent a rolled up portion of the window covering material to an upper unrolled portion of the window covering for maintaining the position of the rolled up portion of the window covering material 5 at a user selected position. Such embodiments may be configured so that the hook 53 of each clip assembly 51 is extendable via a pivotal attachment or other moveable attachment the hook 53 may have to a body 51*a* that is attached to a bottom rail 13 adjacent to a bottom portion of window covering material 5 or attached to the bottom portion of the window covering material 5. For example, clip assemblies 51 positioned adjacent opposite sides of the window covering material 5 and attached to the window covering material 5 adjacent the bottom portion of the window covering material can include a mounting body 51*a* that is connected to the bottom rail 13 and/or a lower portion of the window covering material 5 via at least one fastener (e.g. screw, bolt, staple, rivet, nail, etc.) or other type of fastening mechanism (e.g. adhesive, welding, etc.). The hook 53 can be a hook member that is attached to (e.g. fastened to or defined in) a first end of an elongated body 55 that has a second end portion 57 that is on the opposite end of the elongated body 55. The second end portion 57 can be configured to be pivotally coupled to a pivotal coupling portion 51*b* of the attachment body 51*a*. The attachment portion 51*a* can be structured to also include a housing portion 51*c* that is configured to receive the hook 53 when the clip is in a retracted position so that the hook 53 is at least partially covered by the housing portion 51*c* so that the end of the hook 53 is prevented from becoming tangled in a portion of window covering material 5 as it may be rolled up upon height adjustment of that material. The housing portion 51*c* can also be structured to help ensure that wrapping or other packaging can be fitted around the clips 51 without the hooks 53 puncturing that wrapping to help ensure a more reliable packaging of the window covering during transport of the window covering. In some embodiments, the pivotal coupling portion 51*b* can be located at a first end of the attachment body 51*a* and the housing portion 51*c* can be positioned at a second end of the attachment body 51*a* that is opposite its first end. The clip assemblies 51 can be attached to the bottom rail 13 or window covering material 5 so that the clip assemblies rotate as the window covering material is rolled up or unrolled during height adjustment when the hooks 53 are in their retracted positions. To extend the hooks 53 to their extended positions, as shown in FIG. 16 for example, each of the hooks 53 of the clip assemblies 51 may be rotated via the pivotal attachment that is formed between the pivotal coupling portion 51*b* and the second end 57 of the elongated member 55 from its retracted position in which the elongated member 55 may rest on or extend along the attachment portion 51*a* of the clip to the extended position in which the elongated body may extend away from the attachment portion toward the window covering material so that the hook 53 is positionable through a connector 5*e* that is attached to or defined in the window covering material 5. When the hooks 53 are positioned in connectors 5*e* or otherwise engage respective connectors 5*e* or the window covering material 5, the window covering material position may be maintained via the connection between an upper portion of the window covering material and the rolled up portion of the window covering material (e.g. the bottom rail, or the bottom portion of the window covering material to which the attachment body 51*a* is attached) provided via the extended hooks 53 of the clip assemblies 51. To readjust a position of the window covering material 5, the hooks 53 may be disengaged from connectors 5*e* and the window covering material may then be rolled further up to further raise the material or unrolled to lower the window covering material to a new location. If the window covering material is fully extended, the hooks 53 may not be re-extended as the position of the fully extended window covering material may be maintained by its connection to the first rail 3. If a lower portion of the window covering material 5 is still rolled up after the height adjustment of the window covering material 5, the hooks may be moved from their retracted position back to an extended position for engagement with different connectors 5*e* adjacent the rolled up portion of the window covering material at the adjusted position to maintain the height of the window covering material at the newly selected location. Subsequent height adjustments of the window covering material may then be manually performed in a similar manner.

Referring to FIGS. 17-20, another embodiment of the window covering can include clips 7 that are each structured as a clip assembly 61 positioned adjacent opposite sides of the window covering material 5 for extending from a lower rolled up portion of window covering material to an upper unrolled portion of the window covering material for releasable attachment to connectors 5*e* of the upper unrolled portion of the window covering material. Each clip assembly 61 can include an attachment portion 62 and an extendable hook portion 67. Each hook portion 67 can be configured as a hook member. The extendable hook portion 67 can be moveably connected to the attachment portion 62 via an elongated member 63 and may be releaseably connected to the attachment portion 62 via a mateable body 65 attached to a first end of the elongated member 63. The moveable and/or releasable attachment of the hook portion 67 can permit the hook portion 67 to be moved from between an engaged position to a disengaged position. In some embodiments, the elongated member 53 may be a flexible member such as a line or cord. The hook portion 67 that is configured for releasable engagement with the connectors 5*e* can be attached to the second end 63*b* of the elongated member 63 that is opposite the first end 63*c* attached to the mateable body 65.

The hook portions 67 of the clip assemblies 61 can be removed from connectors 5*e* when moved to their disengaged positions so that the rolled up portion of the window covering material may be further rolled up or unrolled to adjust the position of the window covering material 5. After the window covering material is adjusted to a new position via the unrolling or rolling up of the material, the hooks can be positioned into other connectors 5*e* or placed into engagement with connectors 5*e* to be positioned in one of their engaged positions to maintain the position of the window covering material 5 at its new location. Subsequent repositioning of the window covering material may be performed in a similar way. In the event that the window covering material 5 is moved to a fully extended position, each of the hook portions 5*e* can be connected to a connector for holding the hook portions so that the hook portions and elongated member 63 do not hang downwardly from the bottom rail 13 or bottom portion of the window covering material. As another option, the elongated member 63 and hook portions 67 can be released from their connection to the bottom rail 13 or bottom portion of window covering material by decoupling with the attachment portion 62.

The elongated member 63 may have bodies 63*a* (e.g. beads, spherical bodies, cylindrical shaped bodies, etc.) attached at spaced apart locations along the length of the elongated member 63. The bodies 63*a* may allow the elongated member 63 to be easily gripped by a user. The bodies 63*a* can also be configured to permit the elongated member 63 to be coupled to an end 67*b* of the hook portion 67. For instance, one of the bodies 63 can be sized to be positioned inside an opening defined in the end 67*b* of the hook portion 67 for attachment of the hook portion 67 to the elongated member 63. In other embodiments, other type of attachment mechanisms may be used to attach the hook portion to the elongated member 63.

The end 67*b* of the hook portion 67 may be a second end of the hook portion 67 that is opposite a first end 67*a* that defines a hook that is passed through a connector 5*e* or is otherwise structured for engagement with connectors 5*e*. In other embodiments, the hook portion 67 can be a body that is structured to have different type of structures for attachment to the elongated member 63 and/or connectors 5*e*.

The mateable body 65 for each clip assembly 61 can be sized and configured to be positioned for releasable connection to an attachment portion 62 that has a body that is configured to releaseably connect to the mateable body 65. The attachment portion 62 can be fastened to an end of a bottom rail 13 or to a bottom portion of window covering material 5 via a fastener 62*a* or other type of fastening mechanism. The body of the attachment portion 62 can define a first opening 62*b* and second openings 62*c* that are arranged to releaseably receive the mateable body 65. In some embodiments, the mateable body 65 and the attachment portion 62 can be composed of a polymeric material. In other embodiments, these elements can be composed of wood, metal, an elastomeric material, or other type of suitable material.

In some embodiments, the mateable body 65 can have a nose 65*b* and opposite deformable arms 65*a* that extend from opposite sides of the mateable body such that the nose is located between the opposite deformable arms. The nose 65*b* can be configured to fit within the first opening 62*b* and the arms may be configured to deform to be received through the mouth of the first opening 62*b*. The deformable arms 65*a* can be configured to be biased to extend back to an original position after passing through the mouth of the first opening 62*b* to extend through the second openings 62*c* after having passed through the mouth of the first opening 62*b* and being positioned within the first opening 62*b*. The extension of the deformable arms 62*a* through the second openings 62*c* can result in the arms extending through those openings to help hold the mateable body within the first opening 62*b* to fasten the mateable body 65 to the attachment portion 62. A user may then press the deformable arms 65*a* to compress those arms via deformation so that the arms 65*a* retract out of the second openings 62*c* and into the first opening 62*b* so that the mateable body 65 can be released from the first opening 62*b* after the arms are positioned out of the second openings 62*c* and within the first opening 62*b*.

In other embodiments, the body of the attachment portion 62 may be shaped to fit within an opening defined in the mateable body for releasable connection to the mateable body within that opening. For instance, the attachment portion 62 could be shaped like the mateable body 65 shown in FIG. 19 and the mateable body 65 could be shaped and otherwise configured to define first and second openings 62*b* and 62*c* for releaseably receiving the attachment portion 62 via those openings.

Figure 23:
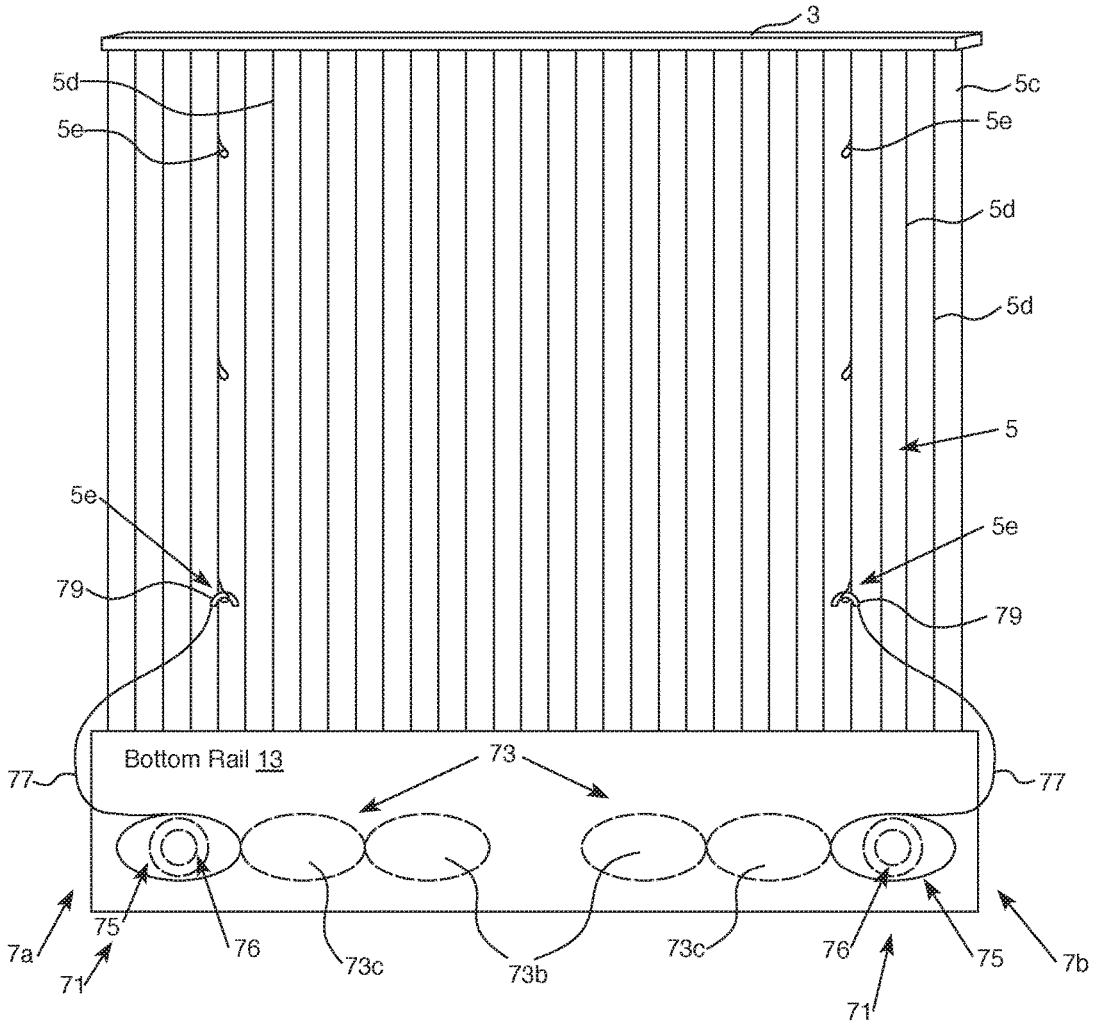
FIG. 23 is a schematic view of the sixth exemplary embodiment of the window covering illustrating the exemplary clip assembly of the sixth exemplary embodiment of the window covering with the window covering material in its first position and the exemplary clip assembly in a second position.

Embodiments of the window covering can also utilize clip assemblies 71 that include hooks 79 or other type of connector that can be configured to move between engaged and disengaged positions for releasable engagement with connectors 5*e* and also be configured to be extendable from and retractable into the bottom rail 13. For instance, hooks 79 can be hook members that are positionable adjacent to opposite ends of the bottom rail 13 when in disengaged positions (e.g. being positioned in contact with ends of the bottom rail or being positioned at least partially within the ends of the bottom rail 13. Each hook 79 can be coupled to a cord 77 that is wound about a rotatable body, such as a collector 75 (e.g. a pulley, reel, etc.). The rotatable body (e.g. collector 75) can be rotatable in a first direction and an opposite second direction (e.g. may be rotatable in counterclockwise and clockwise directions). The cord 77 can be unwound from the collector 75 to extend the hook 79 away from the end of the bottom rail to an engaged position on the window covering material located on an unrolled portion of the window covering material that is above a rolled up portion of the window covering material via engagement with a connector 5*e* as shown in FIG. 23. Such motion of the cord 77 can result in the rotatable body rotating in a first direction or the second direction. The cord 77 can also be retracted from this position back to a position in which the hook is adjacent to an end of the bottom rail or within the bottom rail adjacent that end of the bottom rail 13 after the hook is disengaged from the connector 5*e* for positional adjustment of the window covering material. Such cord retraction motion can result from the rotatable body (e.g. collector 75) rotating in a direction that is opposite the direction the rotatable body rotates when the cord is being unwound from the body. A biasing mechanism can be connected to the collector 75 to bias the collector to wind the cord to retract the cord 77 whenever the hook 79 is not engaged with a connector 5*e*. For example, an internal spring 76 can be coupled within the collector 76 to bias rotation of the collector for retraction of the cord 77 and winding of the cord about the circumference of the collector. Such a spring 76 could be configured as a roll-up shade spring or other type of spring element. In other embodiments, a spring motor 73 could be coupled to the cord collector for biasing the collector 75 to rotate in a first direction for winding of the cord 77. A user may have to exert a force that overcomes the force of the spring motor 73 or spring 76 to extend the hook 79 away from the bottom rail for attachment or engagement with a connector 5*e*.

Figure 22:
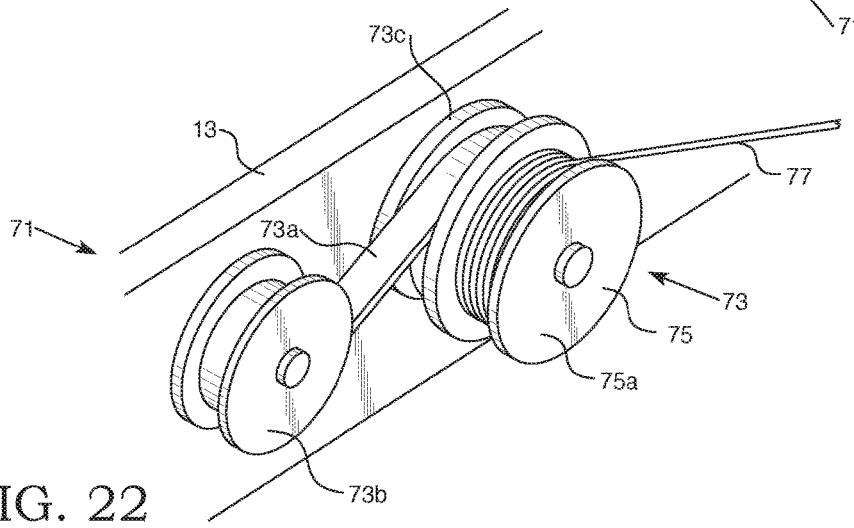
FIG. 22 is a perspective view of an exemplary spring motor unit that may be included in embodiments of the clip assembly that is utilizable in connection with the sixth embodiment of the window covering.

Each cord 77 and hook 79 can be coupled to a respective collector 75 and spring motor 73 or spring 76. For embodiments utilizing a spring motor 73, the spring motor 73 can include first and second pulleys 73*b* and 73*c* and a spring 73*a* that extends between the first and second pulleys. The spring may be an S-shaped spring and be configured to move from one pulley to the other to cause rotation of the collector 75 in one direction. The spring may also be configured to be collected on a different pulley when a user applies a force onto the hook 79 to extend the hook 79 to a position for engagement with a connector 5*e* to permit rotation of the collector 75 for unwinding of the cord 77. For instance, each spring motor 73 can be coupled to a cord collector 75 by an attachment of one of the pulleys of the spring motor to the collector 75 via teeth that may extend from a pulley of the spring motor for intermeshing with teeth on the cord collector or by the cord collector being affixed to the pulley of the spring motor such that rotation of the spring motor pulley also causes motion of the cord collector. As another example, as shown in FIG. 22, the collector 75 could be a collector 75*a* that is one pulley of a double pulley arrangement in which the other pulley of the double pulley is a pulley of the spring motor (e.g. second pulley 73*c*).

The window covering material 5 can be manipulated by a user to roll up the bottom portion of the window covering material to raise the window covering material 5 to a desired location. The hooks 79 can then be extended from opposite ends of the bottom rail such that the cords 77 extend out of the ends of the bottom rail via rotation of collectors 75 until the hooks 79 are engaged with respective connectors 5*e* on the window covering material 5. The engagement of the hooks 79 to the connectors 5*e* can maintain the position of the window covering material at the selected position due to the spring mechanisms coupled to the collectors 75 preventing further rotation of the cord collectors and biasing the cord collectors to rotate to wind the cords 77 upon the collectors 75. A user may then choose to reposition the window covering material by unrolling at least a portion of the material or further rolling up of the material after disengaging the hooks 79 from the connectors 5*e*. Once a new position is selected, the hooks 79 can be re-extended form the bottom rail for engagement with other connectors 5*e*. Other window covering material positional adjustments can be made in a similar way. In the event the window covering material 5 is fully extended to a fully lowered position such that the material is fully unrolled, the hooks 79 may be kept adjacent the ends of the bottom rail 13 (e.g. entirely within the bottom rail at the ends of the bottom rail, at least partially within the bottom rail at the ends of the bottom rail 13 or in contact with the ends of the bottom rail 13 but outside of the bottom rail, etc.) until a user wishes to at least partially raise the window covering material 5.

A brake can be coupled to each spring motor 73. Each brake can be adjustable from a braking position to an unbraking position. When the brake is in the braking position, the brake can function to prevent the spring motor 73 from further biasing the cord collector to wind up more cord when the hook 79 is coupled to a connector 5*e* for maintaining a position of a rolled up portion of window covering material. The brake can be adjusted to an unbraking position so that the spring motor's biasing force is applied to the collector 75 to wind up the cord 77 when the hook 79 is decoupled from a connector for height adjustment of the window covering material so that the hook 79 can be retracted toward the collector 75.

Figure 24:
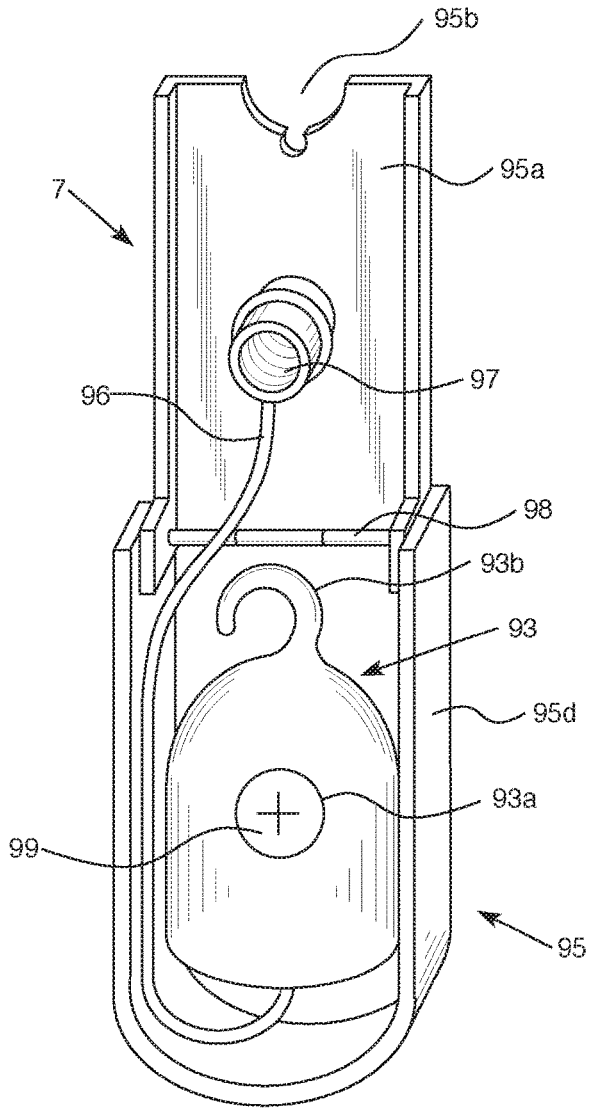
FIG. 24 is a perspective view of an exemplary clip assembly includable in embodiments of the window covering illustrating a first clip orientation for being positioned within a housing.
Figure 25:
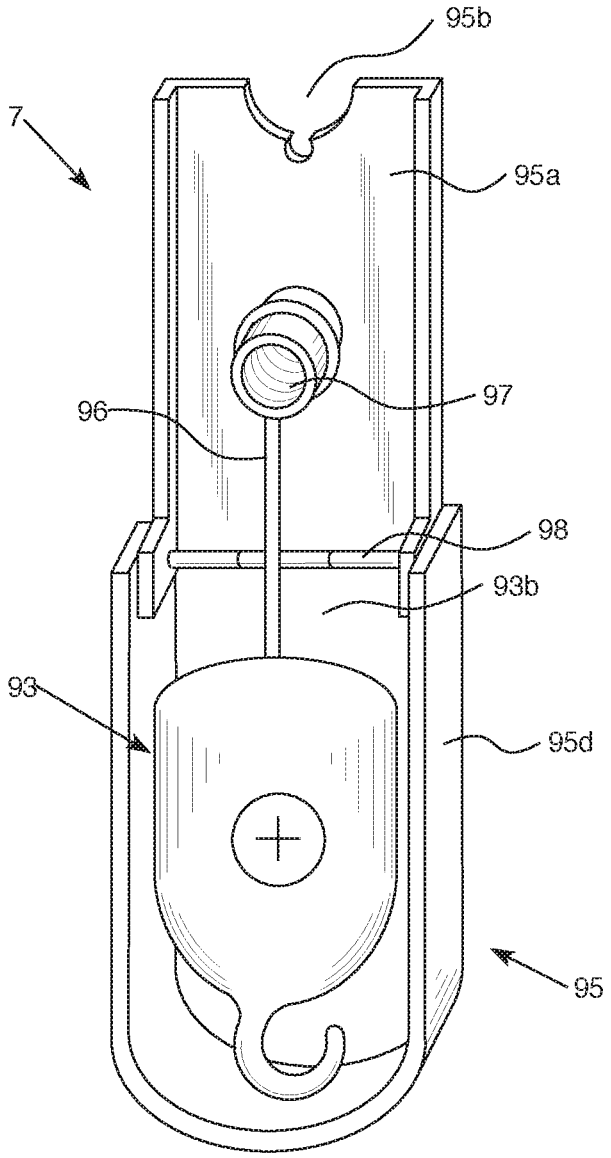
FIG. 25 is another perspective view of the exemplary clip assembly shown in FIG. 24 illustrating an alternative clip orientation in which the clip may be positioned within the housing.

Referring to FIGS. 24-25, another clip assembly 7 that may be utilized in embodiments of a window covering can include first and second clip assemblies 95 that can be configured for attachment to left and right sides of a bottom rail 13 via at least one fastener 99 and/or via attachment to a left and right side of a bottom portion of window covering material via a fastening mechanism. Each clip assembly 95 include a housing that is openable and closeable to permit a hook 93 to be extended and retracted from the housing for attachment to an unrolled portion of window covering material for extending from adjacent a rolled up portion of window covering material to an unrolled portion of window covering material located above the rolled up portion to maintain a position of a rolled up portion of the window covering material at a user selected position. Each clip assembly 95 can have a hook having a body 93 that defines an openings 93*a* and a hook portion 93*b* that extends from an end of the body that is sized and configured to releaseably attach to connectors 5*e* attached to or defined in the window covering material 5. A cord 96 or other type of flexible elongated member may extend from the body of the hook to a protuberance attached to a first section 95*a* of a housing of the clip assembly that is moveable between opened and closed positions via a hinge connection 98 connecting the first section 95*a* to a second section 95*d* of the housing. The second section 95*d* can have sidewalls that define a cavity 95*c*. At least one fastener 99 can extend from a sidewall of the second section 95*d* of the housing for attachment to an end of the bottom rail 13 and/or attachment to a bottom portion of window covering material. The cavity 95*c* can be defined by the second section 95*d* of the housing so that when the first section 95*a* is moved to the closed position, the hook is fully positionable within the cavity 95*c* and/or the body 93 of the hook is fully positionable in the cavity 95*c*. The first section 95*a* can define a hole or other type of opening 95*b* that may be sized to permit a cord to extend from and/or to permit a user to grasp the first section 95*a* to provide a force for moving the first section from its closed position to its opened position.

The hook can be extendable and retractable from the housing 95 via opening of the first section of the housing and moving the hook out of the cavity 95*c* and into engagement with a connector 5*e* via hook portion 93*b*. The hook can be retractable for storage within the housing 95 by disengaging the hook portion 93*b* from the connector 5*e* and positioning the opening 93*a* to be received by the protuberance 97 extending from the first section 93*a* of the housing. The first section 93*a* of the housing may then be moved to a closed position to enclose the body 93 of the hook within the cavity 95*c*.

To adjust a window covering material from a fully unrolled position to a partially rolled up and raised position, a user may raise the window covering material via rolling up of the bottom portion of the window covering material about the bottom rail 13. The housing attached to the bottom rail in the closed position that encloses the hook may rotate with the bottom rail 13 as the window covering material is rolled up to a desired position. The user may then open the first section 95*a* via hinge connection 98 and extend the hook from the housing to engage the hook portion 93*b* with a connector 5*e* above the rolled up portion of window covering material on each clip assembly. The hooks will then hold the position of the window covering material at the desired location. When a user wishes to reposition the window covering material, the hook portions 93*b* may be disengaged and the bodies 93 can be positioned on the protrusions 97 via openings 93*a* to position the hooks in the cavities of the housings. The window covering material may then be unrolled or further rolled up. The housings may then be opened, the hooks extended from the cavities 95*c* for attachment or engagement with new connectors 5*e* above the rolled up portion of the window covering material to maintain the window covering material at the new location. Further changes can be made to the position of the window covering material in the same way. If the user wishes to fully unroll the window covering material, the hooks may be kept enclosed within the housings until the user again wishes to roll up a portion of the window covering material.

It should be appreciated that embodiments of the window covering and method of making and using the window covering can vary to account for different design objectives. For example, the type of window covering material that is utilized may be any of a desired number of different types of material to provide a desired aesthetic effect and/or a desired insulative property. The material may be sheer, may be light filtering, may be light blocking, or may have other properties as well. As another example, the first rail 3 can be composed of a wood, be an extruded metal rail, or be a polymeric rail and also have any number of different structural shapes and configurations (e.g. an elongated beam, a bar, a rod, etc.). The first rail 3 may have an internal conduit defined therein, may have a channel, or may be a solid structure and have a cross section that is rounded, circular, oval, polygonal, or have another type of shape. In some embodiments, it is contemplated that the first rail 3 may have profiles or connector elements that are configured to receive portions of the clips so the clips can be attached to the first rail and extend from the first rail to the rolled up portion of window covering material when the window covering material is in a fully retracted position, fully raised position, or fully open position.

As yet another example, embodiments of the window covering can be configured so that there are no lift cords utilized to effect positional adjustment of the window covering material and no lift cord control mechanism (e.g. cord lock, spring motor, electric motor, loop cord drive, etc.). It is also contemplated that embodiments of the window covering could include such features. For instance, it is contemplated that some embodiments of the window covering that may be configured as a top down bottom up shade may have an upper rail that includes a cord lock and lift cords that extend from the upper rail 4 to the first rail that are moveable to adjust a position of the first rail 3.

As yet another example, embodiments of the window covering that include clips 7 or other types of clip assemblies and the connectors 5*e* may be configured so that the clip 7 (e.g. hook members of the clip or clip assembly) and connectors 5*e* each have any of a number of different shapes, structures, or configurations. In some embodiments, the connectors 5*e* may be formed in the window covering material 5 and in other embodiments the connectors may be attached to the window covering material 5 (e.g. via attachment to elongated members 5*d* or via attachment to another portion of the window covering material). The ends of each of the clips can have any of a number of different shapes or configurations to facilitate releasable attachment to a connector 5*e* attached to or defined in the window covering material 5.

As yet another example, it is contemplated that the clips 7 can be designed or configured to provide a desired aesthetic effect to the window covering material 5. For instance, the clips 7 could be configured so that one or more elements are attachable between the clips to provide a particular type of aesthetic effect that may compliment the look provided by the window covering material 5. Such elements could include fabric, ribbon, or other material having a certain type of color or shape, for example. As yet another example, the clips may be configured and colored to mimic the appearance of the window covering material to provide a camouflage-like effect to try and minimize the noticeability of the clips 7. For instance, the clips could be composed of transparent, or clear, material or may be composed of material having the same color or similar color of the window covering material 5. As yet another example, the hook members of the clips or clip assemblies may be structured to include a hook body and/or may also include a type of moveable arm that is moveable to permit a mouth of the hook to be opened for receiving a connector 5*e* and also being moved to close that mouth so that a connector 5*e* inserted into the mouth of the hook is retained by the hook and moveable arm. Such embodiments of the hook members of the clips or clip assemblies having moveable locking arms can be configured as a lockable hook or a self-locking hook, for example.

As yet another example, embodiments of the window covering may include mounting hardware for mounting the first rail adjacent to a window frame or a door frame. The mounting hardware may include brackets sized to receive and hold the first rail and fasteners that may be used to fasten the brackets to a structure adjacent a window or a doorway. Attachment of the first rail 3 to the brackets may be utilized to mount the window covering adjacent a window or a doorway. For such embodiments, the first rail 3 may be configured as a headrail. Thus, while certain exemplary embodiments of window covering and methods of making and using the same have been shown and described above, it is to be distinctly understood that the invention is not limited thereto but may be otherwise variously embodied and practiced within the scope of the following claims.

What is claimed is:

1. A window covering comprising:

a first rail;

window covering material connected to the first rail such that the window covering material is moveable between a first position and a second position, a first lower portion of the window covering material and a second portion of the window covering material being rolled up when the window covering material is in the second position, a third portion of the window covering material being located above the first and second portions of the window covering material when the window covering material is in the second position;

a first clip attachable to the window covering material to extend between (i) the third portion of the window covering material and the first portion of the window covering material or (ii) the third portion of the window covering material and the second portion of the window covering material when the window covering material is in the second position to maintain the window covering material in the second position; and the first clip being removable from at least the third portion of the window covering material to facilitate adjustment of the window covering material from the second position to a third position that is located between the first and second positions, the first portion of the window covering material being rolled up when the window covering material is in the third position; the first clip being reattachable to the window covering material such that the first clip extends between the first portion of the window covering material and an unrolled portion of the window covering material that is above the first portion to engage the window covering material to maintain the window covering material in the third position;

a second clip attachable to the window covering material to extend between (i) the third portion of the window covering material and the first portion of the window covering material or (ii) the third portion of the window covering material and the second portion of the window covering material when the window covering material is in the second position;

the second clip being removable from the third portion of the window covering material to facilitate adjustment of the window covering material from the second position to the third position, the second clip being reattachable to the window covering material such that the second clip extends between the first portion of the window covering material and an unrolled portion of the window covering material that is above the first portion to engage the window covering material to maintain a location of the first portion of the window covering material when the window covering material is in the third position;

wherein the first clip has a first upper end that is releaseably engageable with the window covering material such that spaced apart prongs of the first upper end of the first clip is moveable away from the window covering material to disengage the window covering material via sideward motion away from the window covering material and a second lower end of the first clip is connected to the window covering material; and wherein the second clip has a first upper end that is releaseably engageable with the window covering material such that spaced apart prongs of the first upper end of the second clip is moveable away from the window covering material to disengage the window covering material via sideward motion away from the window covering material and second lower end of the second clip is connected to the window covering material.

2. The window covering of claim 1, wherein the unrolled portion of the window covering material includes the second portion of the window covering material when the window covering material is in the third position, the second portion of the window covering material being above the first portion of the window covering material and below the third portion of the window covering material when the window covering material is in the third position.

3. The window covering of claim 1, wherein the window covering material has a first side and a second side that is opposite the first side, the first clip being attached to the window covering material adjacent the first side and the second clip being attached to the window covering material adjacent the second side.

4. The window covering of claim 3, comprising a second rail attached to a bottom portion of the window covering material, the first clip attached adjacent to the first side of the window covering material via attachment to the second rail and the second clip attached adjacent to the second side of the window covering material via attachment to the second rail.

5. The window covering of claim 3, wherein the first clip is configured to be removable from the third portion of the window covering material by motion of the first clip from an engaged position to a disengaged position, the fingers of the first clip being configured as prongs that contact the third portion of the window covering material when the first clip is in the engaged position and do not contact the third portion of the window covering material when the first clip is in the disengaged position; and wherein the second clip is configured to be removable from the third portion of the window covering material by motion of the second clip from an engaged position to a disengaged position, the fingers of the second clip being configured as prongs that contact the third portion of the window covering material when the second clip is in the engaged position do not contact the third portion of the window covering material when the second clip is in the disengaged position.

6. The window covering of claim 1, wherein:

a bottom end of a body of the first clip is attached to the window covering material or a second rail, the second rail being attached to the window covering material;

a bottom end of a body of the second clip is attached to the window covering material or the second rail;

the fingers of the first clip being rotatably connected to the body of the first clip; and the fingers of the second clip being rotatably connected to the body of the second clip.

7. The window covering of claim 1, wherein:

a bottom end of a body of the first clip is attached to the window covering material or a second rail, the second rail being attached to the window covering material;

a bottom end of a body of the second clip is attached to the window covering material or the second rail;

the body of the first clip is configured to bend or flex for effecting the sideward motion of the first clip; and the body of the second clip is configured to bend or flex for effecting the sideward motion of the second clip.

8. The window covering of claim 1, wherein the window covering material is comprised of fabric material, a sheet of material, non-woven fabric material, woven bamboo, or a plurality of slats.

9. A window covering comprising:

a first rail;

window covering material connected to the first rail such that the window covering material is moveable between a first position and a second position, a first lower portion of the window covering material and a second portion of the window covering material being rolled up when the window covering material is in the second position, a third portion of the window covering material being located above the first and second portions of the window covering material when the window covering material is in the second position;

a first clip attachable to the window covering material to extend between (i) the third portion of the window covering material and the first portion of the window covering material or (ii) the third portion of the window covering material and the second portion of the window covering material when the window covering material is in the second position to maintain the window covering material in the second position; and the first clip being removable from the third portion of the window covering material to facilitate adjustment of the window covering material from the second position to a third position that is located between the first and second positions, the first portion of the window covering material being rolled up when the window covering material is in the third position; the first clip being reattachable to the window covering material such that the first clip extends between the first portion of the window covering material and an unrolled portion of the window covering material that is above the first portion to engage the window covering material to maintain the window covering material in the third position;

wherein the first clip has a first upper end that is engageable with the window covering material such that spaced apart fingers of the first upper end of the first clip is moveable away from the window covering material to disengage the window covering material via sideward motion away from the window covering material so that the window covering material is moveable when the first upper end is disengaged from the window covering material; and a second lower end of the first clip is connected to the window covering material adjacent a first side of the window covering material.

10. The window covering of claim 9, comprising:

a second clip attachable to the window covering material to extend between (i) the third portion of the window covering material and the first portion of the window covering material or (ii) the third portion of the window covering material and the second portion of the window covering material when the window covering material is in the second position; and the second clip being removable from at least the third portion of the window covering material to facilitate adjustment of the window covering material from the second position to the third position, the second clip being reattachable to the window covering material such that the second clip extends between the first portion of the window covering material and an unrolled portion of the window covering material that is above the first portion to engage the window covering material to maintain a location of the first portion of the window covering material when the window covering material is in the third position.

11. The window covering of claim 9, wherein the window covering material is moveable via manual motion of the window covering material without use of any lift cords, without use of an electric motor and without use of a spring motor.

12. The window covering of claim 9, wherein the window covering material has a second side that is opposite the first side, the window covering also comprising:

a second rail attached to a bottom portion of the window covering material, the first clip attached adjacent to the first side of the window covering material via attachment to an end of the second rail.

13. The window covering of claim 9, wherein the first clip is configured to be removable from the third portion of the window covering material by motion of the first clip from an engaged position to a disengaged position, the fingers of the first clip being configured as prongs that contact the third portion of the window covering material when the first clip is in the engaged position and that do not contact the third portion of the window covering material when the first clip is in the disengaged position.

14. The window covering of claim 9, wherein the unrolled portion of the window covering material includes the second portion of the window covering material when the window covering material is in the third position, the second portion of the window covering material being above the first portion of the window covering material and below the third portion of the window covering material when the window covering material is in the third position.

15. The window covering of claim 9, wherein the window covering material is comprised of fabric material, a sheet of material, non-woven fabric material, woven bamboo, or a plurality of slats.

16. The window covering of claim 9, wherein:

the first clip comprises a body attached to the fingers;

a bottom end of the body of the first clip is attached to the window covering material or a second rail, the second rail being attached to the window covering material.

17. The window covering of claim 16, wherein the fingers of the first clip are rotatably connected to the body of the first clip.

18. The window covering of claim 16, wherein the body of the first clip is configured to bend or flex for effecting the sideward motion.

* * * * *